US005459024A

United States Patent [19]

Saito et al.

[11] Patent Number: 5,459,024

[45] Date of Patent: Oct. 17, 1995

[54] SILVER HALIDE COLOR PHOTOGRAPHIC MATERIALS

[75] Inventors: Naoki Saito; Akira Ogawa; Hajime Nakagawa, all of Kanagawa, Japan

[73] Assignee: Fuji Photo Film Co., Ltd., Kanagawa, Japan

[21] Appl. No.: 400,269

[22] Filed: Mar. 3, 1995

Related U.S. Application Data

[63] Continuation of Ser. No. 52,670, Apr. 27, 1993, abandoned.

[30] Foreign Application Priority Data

Apr. 28, 1992 [JP] Japan ..... 4-134523

[51] Int. Cl.[6] ..... G03C 7/36

[52] U.S. Cl. ..... 430/556; 430/557

[58] Field of Search ..... 430/556, 557, 430/558

[56] References Cited

U.S. PATENT DOCUMENTS

| | | | |
|---|---|---|---|
| 4,579,816 | 4/1986 | Ohlschlager et al. | 430/544 |
| 4,617,256 | 10/1986 | Kunitz et al. | 430/557 |
| 5,035,987 | 7/1991 | Odenwalder et al. | 430/544 |
| 5,194,369 | 3/1993 | Mihayashi et al. | 430/544 |
| 5,212,052 | 5/1993 | Sakanone et al. | 430/557 |
| 5,213,958 | 5/1993 | Motoki et al. | 430/557 |

FOREIGN PATENT DOCUMENTS

| | | | |
|---|---|---|---|
| 447920A1 | 3/1991 | European Pat. Off. . | |
| 0147426 | 4/1981 | Germany | 430/557 |
| 62-71251 | 12/1987 | Japan . | |
| 213777 | 4/1990 | Japan . | |
| 13777 | 4/1990 | Japan . | |

*Primary Examiner*—Lee C. Wright

*Attorney, Agent, or Firm*—Birch, Stewart, Kolasch & Birch

[57] ABSTRACT

The present invention relates to color photographic materials having improved sharpness, higher photographic speeds and increased fastness by forming the image in the presence of couplers wherein the rate of dye formation is high, the color forming density is high and the dye which is formed has a high degree of fastness. The coupler compound represented by formula (I) indicated below is contained in at least one hydrophilic colloid layer on a support of a silver halide color photographic material.

$$R^1R^2NCOCHXCONH\text{-}\phi^1\text{-}SO_2NR^3\text{-}\phi^2 \quad (I)$$

In formula (I), $R^1$ and $R^2$ each independently represents an alkyl group, an aryl group or a heterocyclic group, $R^3$ represents a hydrogen atom, an alkyl group, an aryl group or a heterocyclic group, X represents a group which can be eliminated when the coupler compound reacts with an oxidized product of a primary aromatic amine developing agent, $\phi^1$ represents a phenylene group, $\phi^2$ represents an aryl group or a heterocyclic group, and $R^1$ and $R^2$, $R^3$ and $\phi^1$, or $R^3$ and $\phi^2$ may be linked to form a ring.

20 Claims, No Drawings

SILVER HALIDE COLOR PHOTOGRAPHIC MATERIALS

This application is a continuation, of application Ser. No. 08/052,670 filed on Apr. 27, 1993, now abandoned.

FIELD OF THE INVENTION

The present invention relates to silver halide color photographic materials which contain novel couplers and, more precisely, it concerns color photographic materials wherein improved sharpness, higher photographic speed and superior colored image fastness in particular can be realized by forming the colored images in the presence of novel couplers which have a high reactivity and with which the fastness of the dyes which are formed is high.

BACKGROUND OF THE INVENTION

With a color photographic material the image is formed by subjecting the material to an exposure to light and then carrying out color development wherein the couplers react with the oxidized primary aromatic amine based developing agent. In such a system the reproduction of colors is achieved using the subtractive color method with the formation of yellow, magenta and cyan colored images which have a complementary relationship for the reproduction of blue, green and red.

The basic requirements of each coupler are not only that it should form a single color but it should also have various desirable characteristics such as the formation of a dye which has excellent spectral absorption characteristics, a high rate of dye formation, a high color forming density and the formation of a dye which is very fast with respect to light, heat and moisture. Today, in particular, when there is a demand for high photographic speeds and higher picture quality from photosensitive materials there is a strong demand for the development of couplers wherein the rate of dye formation is high and the color forming density is high. Moreover, the properties mentioned above are very important requirements when designing DIR couplers (these are couplers which release a development inhibitor on reaction with the oxidized form of a primary aromatic amine developing agent and they are used with a view to improving picture quality in terms of sharpness and color reproduction).

The introduction of highly polar groups, and especially sulfonamido groups or sulfamoyl groups, into the coupler molecule is one effective means of increasing the rate of dye formation, and such couplers have been disclosed, for example, in JP-A-52-115219, JP-A-54-48541, JP-A-63-201655, JP-B-2-13777, U.S. Pat. Nos. 4,525,450 and 4,356,258. (The term "JP-A" as used herein signifies an "unexamined published Japanese patent application", and the term "JP-B" as used herein signifies an "examined Japanese patent publication".) The introduction of an acidic leaving group into the coupler is another effective means and examples of this include the introduction of p-hydroxybenzenesulfonyl group or p-hydroxybenzenesulfinyl group as disclosed in U.S. Pat. No. 4,443,536 and the introduction of N-acylsulfamoyl group as disclosed in British Patent 909,318, JP-B-62-61251 and U.S. Pat. No. 4,617,256. However, these couplers have a disadvantage in that the fastness of the colored image deteriorates as the rate of dye formation is increased, and further improvement is desirable.

SUMMARY OF THE INVENTION

The object of the present invention is to provide color photographic materials wherein improved sharpness, higher photographic speed and increased fastness can be achieved by forming the image in the presence of a coupler wherein the rate of dye formation is high, the color formation density is high and the dye which is formed has a high degree of fastness.

The object of the invention has been realized by means of a silver halide color photographic material comprising a support having provided thereon at least one hydrophilic colloid layer containing a coupler represented by formula (I):

$$R^1R^2NCOCHXCONH\text{-}\phi^1\text{-}SO_2NR^3\text{-}\phi^2 \quad (I)$$

wherein $R^1$ and $R^2$ each independently represents an alkyl group, an aryl group or a heterocyclic group, $R^3$ represents a hydrogen atom, an alkyl group, an aryl group or a heterocyclic group, X represents a group which can be eliminated when the coupler compound reacts with an oxidized product of a primary aromatic amine developing agent, $\phi^1$ represents a phenylene group and $\phi^2$ represents an aryl group or a heterocyclic group, and $R^1$ and $R^2$, $R^3$ and $\phi^1$, or $R^3$ and $\phi^2$ may be linked to form a ring.

DETAILED DESCRIPTION OF THE INVENTION

Thus, the aforementioned coupler compounds which can be represented by formula (I) of the present invention are contained in a hydrophilic colloid layer and they are coupler compounds which provide a high rate of dye formation and a high color forming density, and they also perform as DIR couplers which can be used with a view to improving the sharpness and color reproduction in terms of picture quality. Thus, it is possible to obtain images which have excellent sharpness, a high photographic speed and a high degree of fastness by using silver halide color photographic materials of the present invention.

The conventional couplers aforementioned have a disadvantage in that the colored image fastness deteriorates as the rate of dye formation increases, but this is resolved by means of the present invention.

The compounds which can be represented by formula (I) which can be used in the present invention are described in detail below.

The alkyl groups which can be represented by $R^1$, $R^2$ and $R^3$ in formula (I) have from 3 to 30, and preferably from 3 to 22 carbon atoms, and they may be linear chain, branched or cyclic. Examples include methyl, ethyl, propyl, isopropyl, t-butyl, t-amyl, cyclopropyl, cyclohexyl, 2-ethylhexyl, isobutyl, isoamyl, t-octyl, neopentyl and dodecyl, and these may be further substituted.

The aryl groups which can be represented by $R^1$, $R^2$, $R^3$ and $\phi^2$ in formula (I) have from 6 to 20, preferably from 6 to 10, and most desirably 6 carbon atoms. Examples include phenyl, naphthyl and anthracenyl, and these may be further substituted.

The heterocyclic groups which can be represented by $R^1$, $R^2$, $R^3$ and $\phi^2$ in formula (I) are preferably from five to seven membered rings which preferably have nitrogen, oxygen and sulfur as hetero atoms, and they preferably have from 1 to 10 carbon atoms. Examples include 2-furyl, 2-thienyl, 2-pyridyl, 2-imidazolyl, 2-( 1,3-oxazolyl), 5-tetrazolyl, 1-piperidinyl, 5-indolinyl, 1,3,4-thiadiazolyl, benzoxazol-2-yl, benzothiazol- 2-yl, benzimidazol-2-yl, 1,2,4-triazol-5-yl, 3-pyrazolyl, 2-morpholyl, 4-morpholyl, 2-quinolyl and 2-quinazolyl, and these may be further substituted.

In formula (I), X represents a group which can be eliminated as an anion ($X^-$) when the coupler compound reacts with the oxidized product of a primary aromatic amine developing agent. X is preferably an aryloxy group ( for example phenoxy, naphthoxy ), a heterocyclic oxy group, an arylthio group, a heterocyclic thio group, an imido group which is bonded by a nitrogen atom to the coupling position (for example 2,4-dioxo-1,3-imidazolidin 3-yl, 2,4-dioxo-1, 3-oxazolidin-3-yl, 3,5-dioxo-1,2,4-triazolidin-4-yl, succinimido, phthalimido, 2,4-dioxo-1,3-imidazolidin-1-yl and the like) or an unsaturated nitrogen containing heterocyclic group which is bonded by a nitrogen atom to the coupling position (for example 1-imidazolyl, 1-pyrazolyl, 1,2,4-triazol-1-(or - 4-)-yl, 1,2,3-triazol-1-yl, benzotriazol-1-yl, 3-pyrazolin-5-on-1-yl and the like).

These leaving groups may be non-photographically useful groups or photographically useful groups or precursors thereof (for example, development inhibitors, development accelerators, de-silvering accelerators, fogging agents, dyes, film hardening agents, couplers, scavengers for the oxidized product of the developing agent, fluorescent dyes, developing agents or electron transfer agents).

Those groups known in the past are useful as actual examples in those cases where X represents a photographically useful group. Those disclosed, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, and European Patents laid open 193389A, 348139A and 272573A can be used. From among the photographically useful groups, a development inhibitor, an electron transfer agent, a desilvering accelerator (bleaching accelerator) or a dye is preferred.

$R^1$, $R^2$, $R^3$, $\phi^1$, $\phi^2$ and X may have substituent groups, and the groups indicated below can be cited as examples of substituent groups.

Halogen atoms (for example fluorine, chlorine) , alkoxycarbonyl groups (which have from 2 to 30, and preferably from 2 to 20 carbon atoms, for example methoxycarbonyl, dodecyloxycarbonyl, hexadecyloxycarbonyl), acylamino groups (which have from 2 to 30, and preferably from 2 to 20 carbon atoms, for example acetamido, tetradecanamido, 2-(2,4-di-t-amylphenoxy)-butanamido, benzamido), sulfonamido groups (which have from 1 to 30, and preferably from 1 to 20 carbon atoms, for example methanesulfonamido, dodecanesulfonamido, hexadecanesulfonamido, benzenesulfonamido), carbamoyl groups (which have from 1 to 30, and preferably from 1 to 20 carbon atoms, for example N-butylcarbamoyl, N,N-diethylcarbamoyl, N-mesylcarbamoyl), sulfamoyl groups (which have from 0 to 30, and preferably from 0 to 20 carbon atoms, for example N-butylsulfamoyl, N-dodecylsulfamoyl, N-hexadecylsulfamoyl, N-3-(2,4-di-t-amylphenoxy)butylsulfamoyl, N,N-diethylsulfamoyl), alkoxy groups (which have from 1 to 30, and preferably from 1 to 20 carbon atoms, for example methoxy, hexadecyloxy, isopropoxy), aryloxy groups (which have from 6 to 20, and preferably from 6 to 10 carbon atoms, for example phenoxy, 4-methoxyphenoxy, 3-t-butyl-4-hydroxyphenoxy, naphthoxy), aryloxycarbonyl groups (which have from 7 to 21, and preferably from 7 to 11 carbon atoms, for example phenoxycarbonyl), N-acylsulfamoyl groups (which have from 2 to 30, and preferably from 2 to 20 carbon atoms, for example N-propanoylsulfamoyl, N-tetradecanoylsulfamoyl, N-benzoylsulfamoyl), sulfonyl groups (which have from 1 to 30, and preferably from 1 to 20 carbon atoms, for example methanesulfonyl, octanesulfonyl, benzenesulfonyl, dodecanesulfonyl), alkoxycarbonylamino groups (which have from 1 to 30, and preferably from 1 to 20 carbon atoms, for example ethoxycarbonylamino, tetradecyloxycarbonylamino), cyano group, nitro group, carboxyl group, hydroxyl group, sulfo group, alkylthio groups (which have from 1 to 30, and preferably from 1 to 20 carbon atoms, for example methylthio, dodecylthio, dodecylcarbamoylmethylthio), ureido groups (which have from 1 to 30, and preferably from 1 to 20 carbon atoms, for example N-phenylureido, N-hexadecylureido), aryl groups (which have from 6 to 20, and preferably from 6 to 10 carbon atoms, for example phenyl, naphthyl, 4-methoxyphenyl), heterocyclic groups (which have from 1 to 20, and preferably from 1 to 10 carbon atoms, being from three to twelve, and preferably five or six membered single rings or condensed rings which contain at least one nitrogen atom, oxygen atom or sulfur atom as a hereto-atom, for example 2-pyridyl, 4-pyridyl, 4-pyrimidinyl, 3-pyrazolyl, 1-pyrrolyl, 2,4-dioxo-1,3-imidazolidin-1-yl, morpholino, indolyl), alkyl groups (linear chain, branched or cyclic, saturated or unsaturated alkyl groups which have from 1 to 30, and preferably from 1 to 20 carbon atoms, for example methyl, ethyl, isopropyl, cyclopropyl, t-pentyl, t-octyl, cyclopentyl, t-butyl, s-butyl, dodecyl, 2-hexyldecyl), acyl groups (which have from 1 to 30, and preferably from 2 to 20 carbon atoms, for example acetyl, benzoyl), arylthio groups (which have from 6 to 20, and preferably from 6 to 10 carbon atoms, for example phenylthio, naphthylthio), sulfamoylamino groups (which have from 0 to 30, and preferably from 0 to 20 carbon atoms, for example N-butylsulfamoylamino, N-dodecylsulfamoylamino, N-phenylsulfamoylamino) and N-sulfonylsulfamoyl groups (which have from 1 to 30, and preferably from 1 to 20 carbon atoms, for example N-mesylsulfamoyl, N-ethanesulfonylsulfamoyl, N-dodecanesulfonylsulfamoyl, N-hexadecanesulfonylsulfamoyl). The abovementioned substituent groups may have further substituent groups. The substituent groups cited here can be cited as examples of such substituent groups.

The couplers represented by formula (I) may form dimers or larger oligomers (for example telomers or polymers) via groups of valency 2 or more in the groups represented by X, $R^1$, $R^2$, $R^3$, $\phi^1$ and $\phi^2$. In such cases the number of carbon atoms may be outside the range which is indicated for the substituent groups aforementioned.

The preferred scope of the coupler compounds represented by formula (I) is described below.

Alkyl groups or aryl groups are preferred for $R^1$ and $R^2$. When $R^1$ and $R^2$ represent alkyl groups these are most desirably primary alkyl groups, and methyl, ethyl, n-propyl, benzyl, phenethyl, n-octyl, n-dodecyl and the like can be cited as examples. When $R^1$ and $R^2$ represent an aryl group it is most desirably a phenyl group.

Cases in which $R^1$ and $R^2$ are not both aryl groups are preferred, and more desirably there are cases in which $R^1$ and $R^2$ are linked to form a ring, and, for example, cases in which $R^1R^2N$— in formula (I) is for example, 1-pyrrolidyl, 1-morpholyl, 1-piperidyl, 1-indolinyl, 1,2,3,4-tetrahydroquinolin-1-yl or 1-benzomorpholinyl can be cited, and of these 1-indolinyl is the most desirable.

$R^3$ is preferably a hydrogen atom.

x is preferably a nitrogen containing heterocyclic group. X is most desirably a five membered cyclic imido group (bonded by the nitrogen atom to the coupling position), 1-pyrazolyl, 1-imidazolyl, 1,2,4-triazolyl (bonded at the 1-position or the 4-position with coupling position), 1-benzotriazolyl or 1,2,3-triazolyl, and from among these 1-benzotriazolyl is preferred.

The linking of the phenylene group represented by $\phi^1$ may be ortho, meta or para, but meta-linking is especially desirable. The preferred substituent groups for $\phi^1$ are a halogen atom or an alkoxy group, and these substituent groups are preferably in an ortho-position with respect to $R^1R^2NCOCHXCONH$—.

Substituent groups which can be represented by $—CO_2R^4$, $—CONR^5R^6$, $—NR^5COR^4$, $—SO_2R^4$, $—SO_2NR^5R^6$ or $—NR^5SO_2R^4$ are especially desirable as substituent groups for $\phi^2$.

Here $R^4$ represents an alkyl group, an aryl group or a heterocyclic group, $R^5$ represents a hydrogen atom, an alkyl group, an aryl group or a heterocyclic group, $R^6$ represents a hydrogen atom, an alkyl group, an aryl group, a heterocyclic group, $—COR^7$, $—CO_2R^7$, $—CONR^8R^9$, $—SO_2R^7$ or $—SO_2NR^8R^9$, $R^7$ represents an alkyl group, an aryl group or a heterocyclic group, and $R^8$ and $R^9$ each independently represents a hydrogen atom, an alkyl group, an aryl group or a heterocyclic group. There may be a plurality of the abovementioned substituent groups for $\phi^2$, and in such a case the plurality of substituent groups may be the same or different, and $R^4$ and $\phi^2$, $R^5$ and $\phi^2$, $R^6$ and $\phi^2$, $R^5$ and $R^6$ or $R^8$ and $R^9$ may be linked to form a ring.

The alkyl groups, aryl groups and heterocyclic groups represented by $R^4$ to $R^9$ are respectively the same as the alkyl groups, aryl groups and heterocyclic groups mentioned in the description of $R^1$ to $R^3$. These may have substituent groups, and those cited as examples of substituent groups for $R^1$ to $R^3$, $\phi^1$, $\phi^2$ and X can be cited as examples of these substituent groups.

Alkyl groups are preferred for $R^4$ and $R^7$ and chain alkyl groups which have not more than two branched chains are especially desirable, and methyl, ethyl, isopropyl, n-butyl, n-hexyl, n-dodecyl, n-hexadecyl, 2-ethylhexyl and the like can be cited as examples.

Hydrogen atoms are preferred for $R^5$ and $R^8$.

An alkyl group or an aryl group is preferred for $R^9$. When $R^9$ represents an alkyl group it is most desirably a chain alkyl group which has not more than two branched chains, and methyl, isopropyl, n-butyl, n-octyl, n-dodecyl, n-hexadecyl, 2-ethylhexyl and the like can be cited as examples. When $R^9$ represents an aryl group it is most desirably a phenyl group.

An alkyl group, $—COR^7$, $—CONR^8R^9$, $—SO_2R^7$ or $—SO_2NR^8R^9$ is preferred for $R^6$.

The couplers represented by formula (I) are preferably couplers of the type which is non-diffusible. The non-diffusible couplers are couplers which have within the molecule a group which has a sufficiently high molecular weight to immobilize the molecule in the layer to which it has been added. In general, an alkyl group which has a total number of carbon atoms of from 8 to 30, and preferably of from 10 to 20, or an aryl group which has substituent groups which have a total number of carbon atoms of from 4 to 20 is used. Any of these ballast groups may be substituted into the molecule, and a plurality of these groups may be included.

Actual examples of couplers which can be represented by formula (I) are indicated below, but the invention is not limited by these examples.

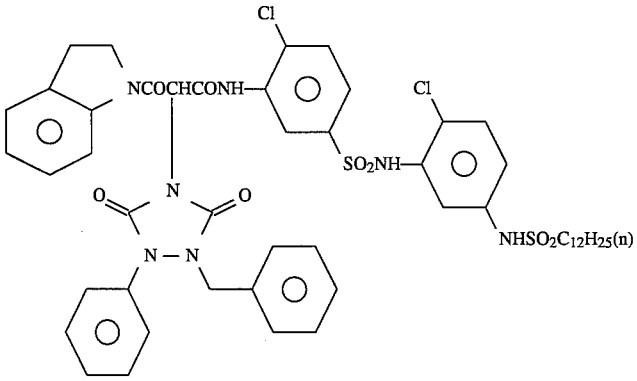

(1)

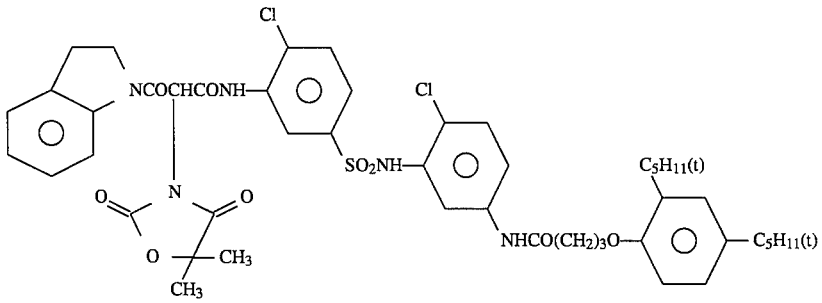

(2)

-continued
(3)
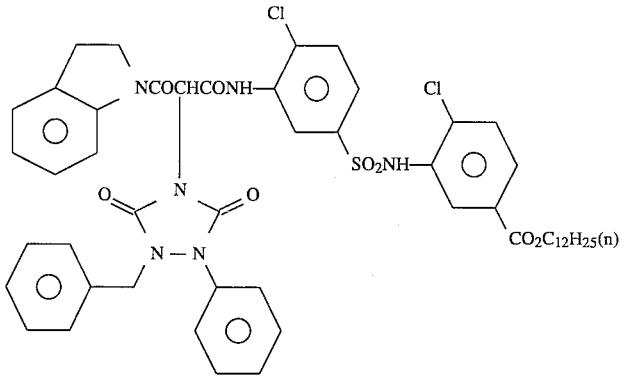
(4)
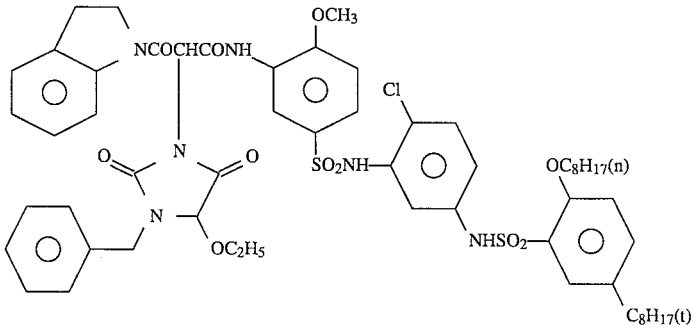
(5)
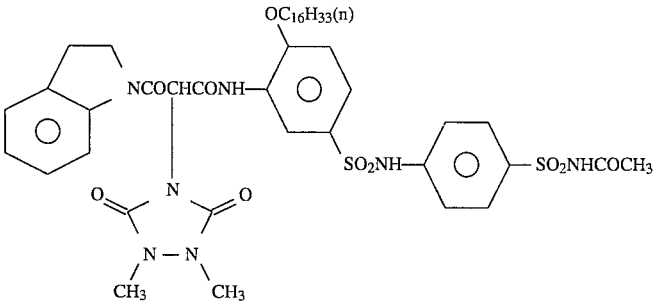
(6)
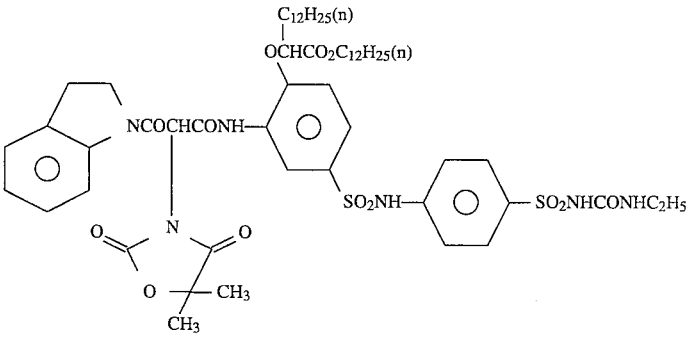
(7)
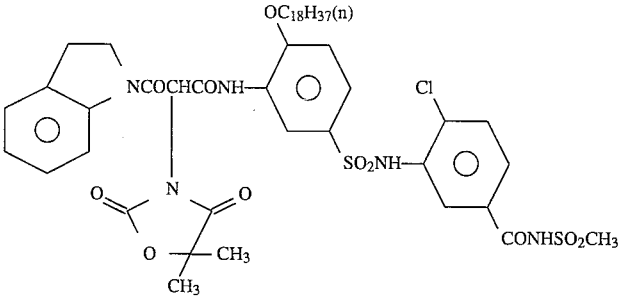

-continued
(8)
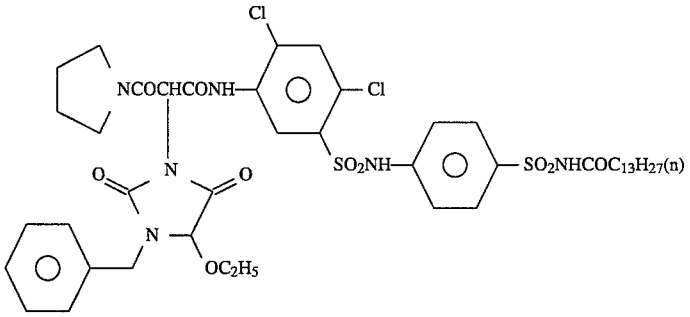
(9)
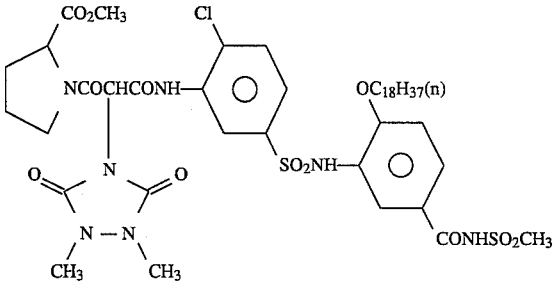
(10)
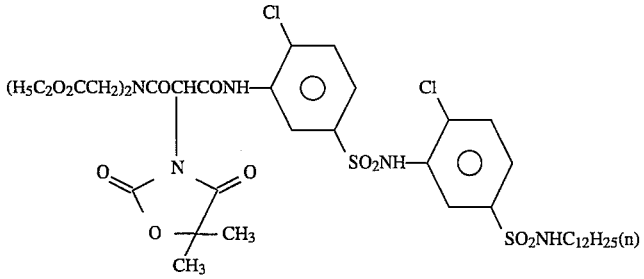
(11)
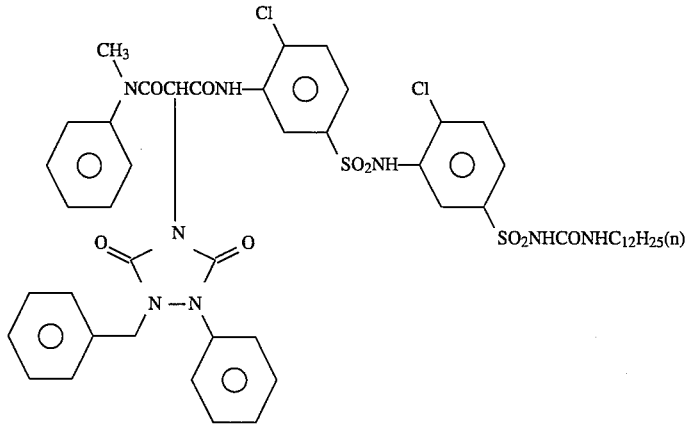
(12)
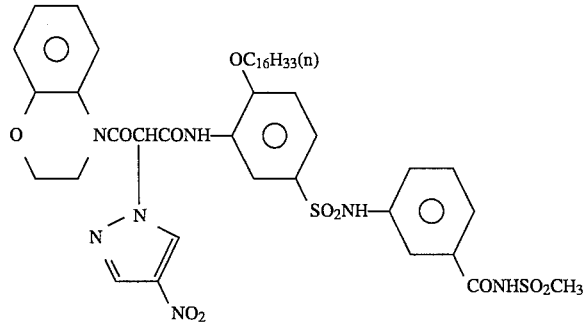

-continued
(13)
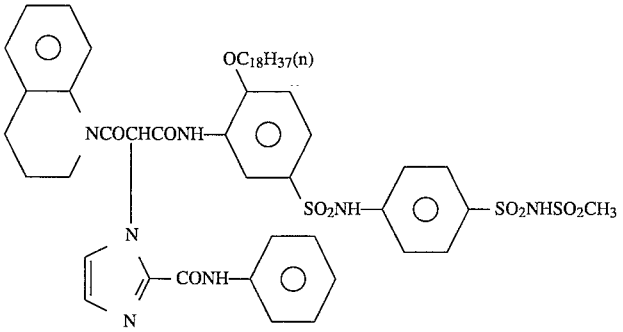
(14)
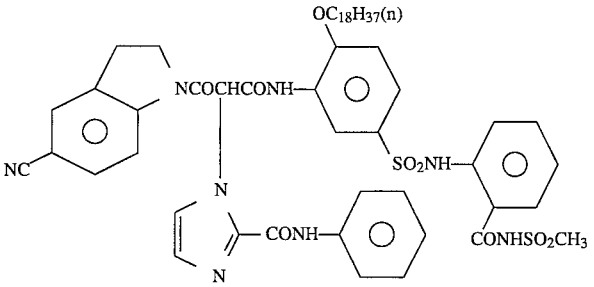
(15)
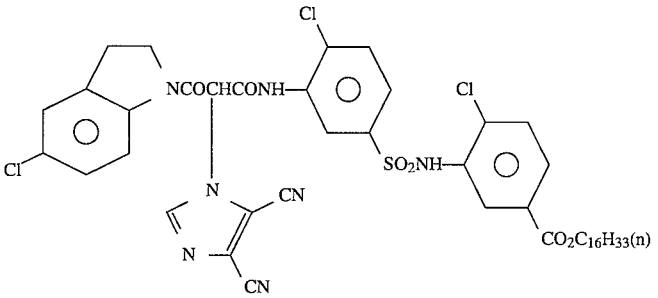
(16)
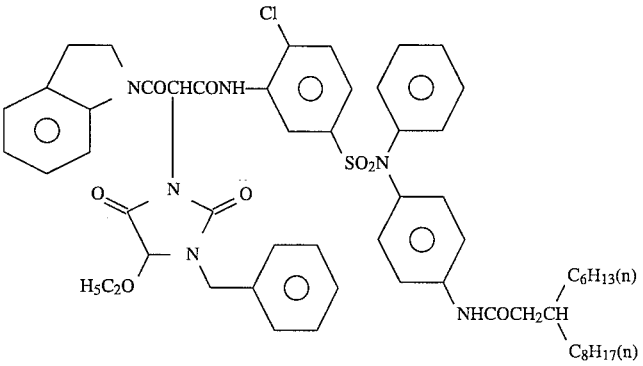

-continued
(17)
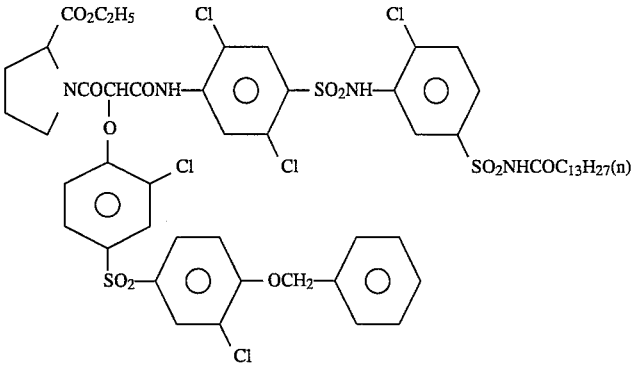
(18)
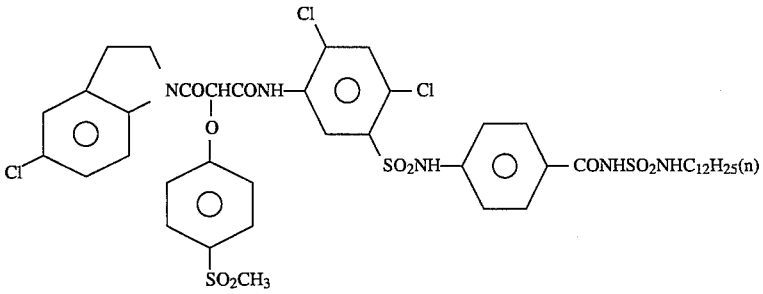
(19)
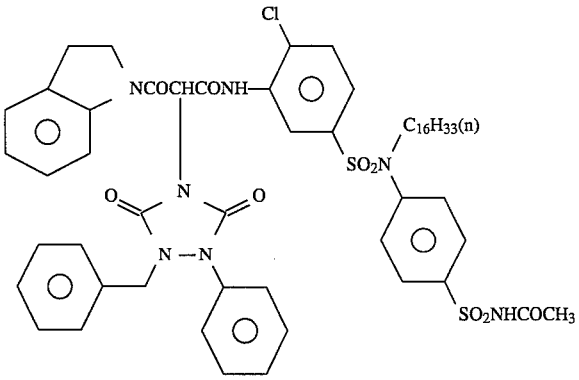
(20)
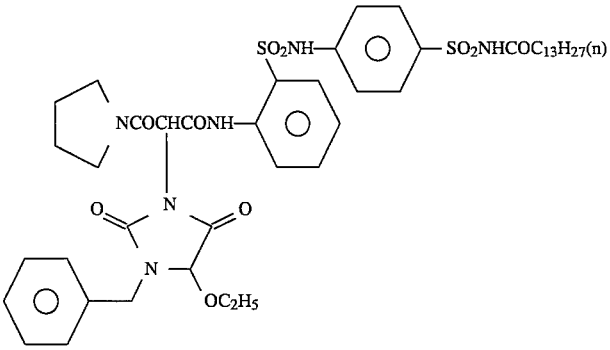

-continued
(21)
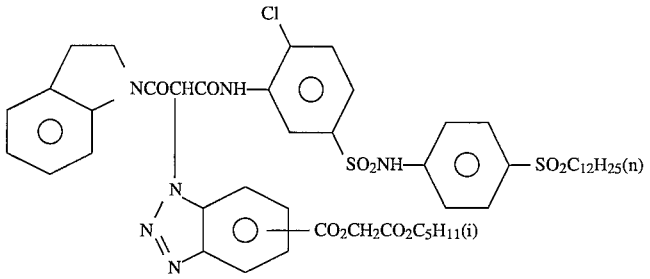
(22)
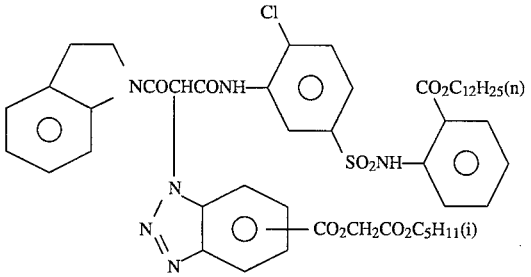
(23)
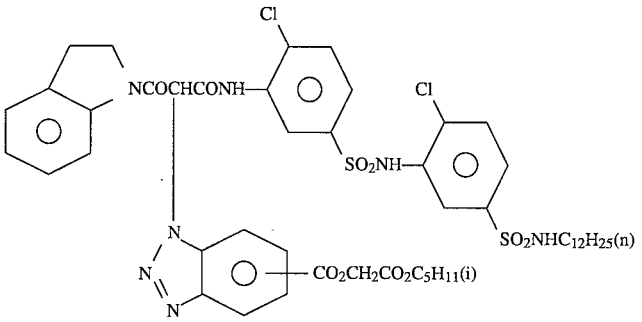
(24)
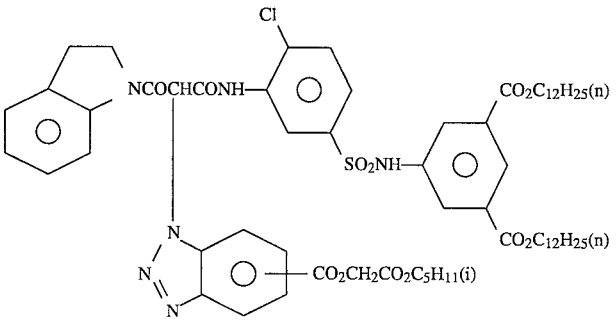
(25)
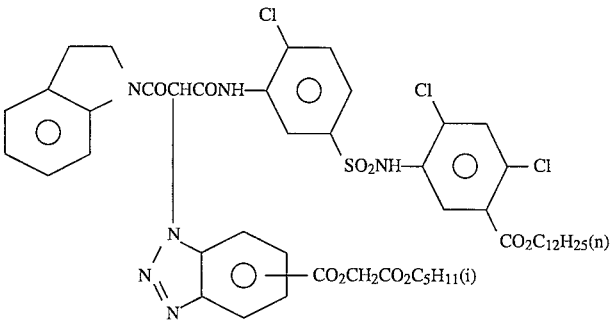

-continued
(26)
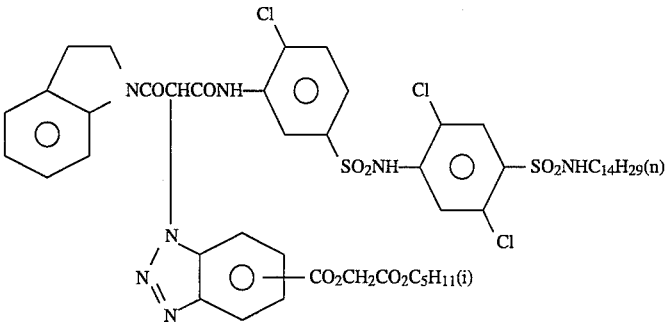
(27)
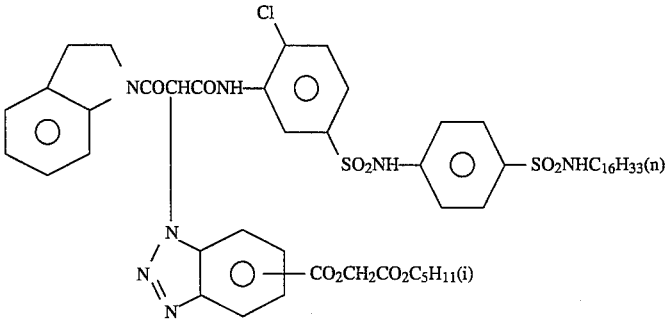
(28)
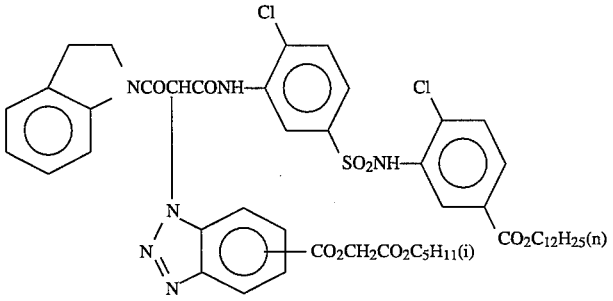
(29)
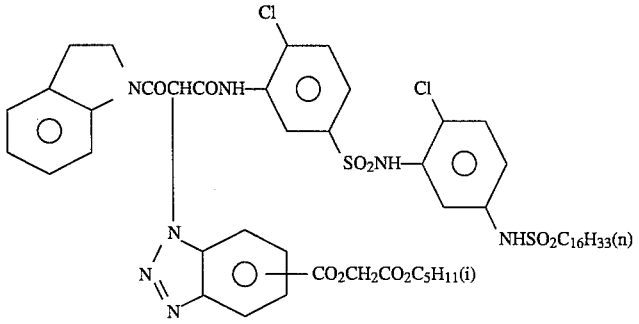
(30)
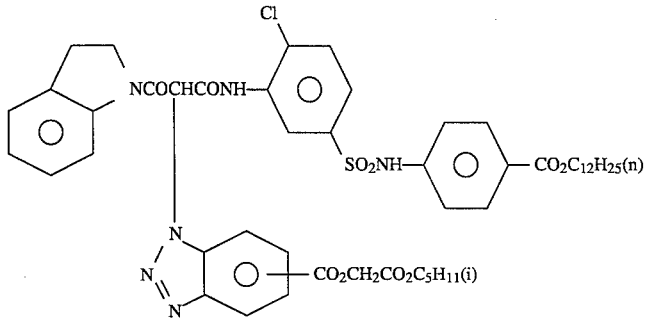

-continued
(31)
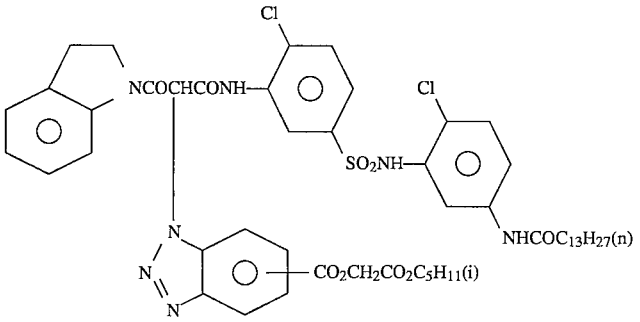
(32)
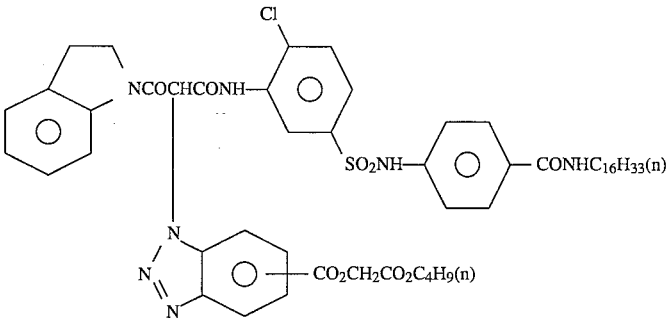
(33)
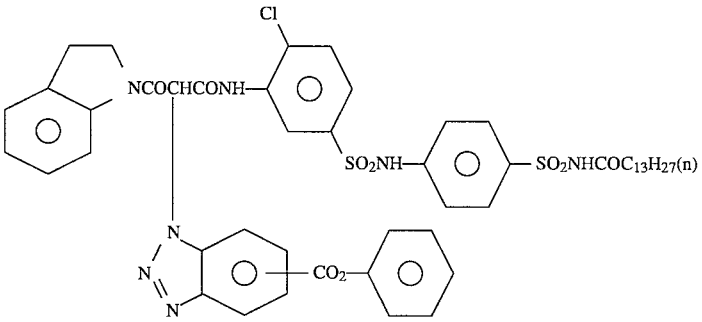
(34)
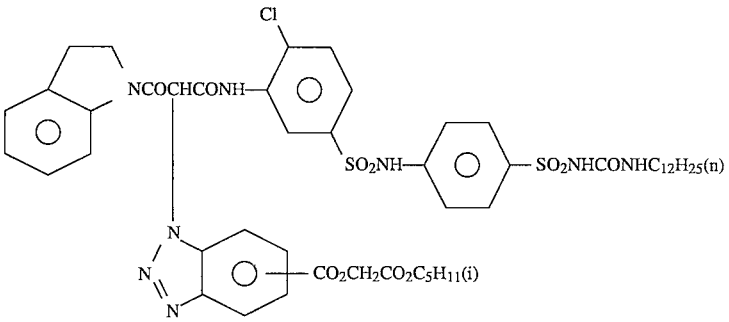
(35)
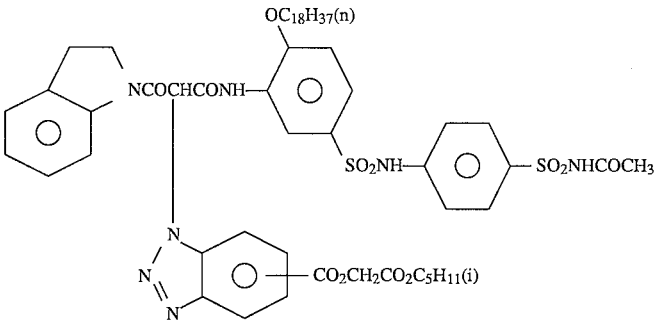

-continued
(36)
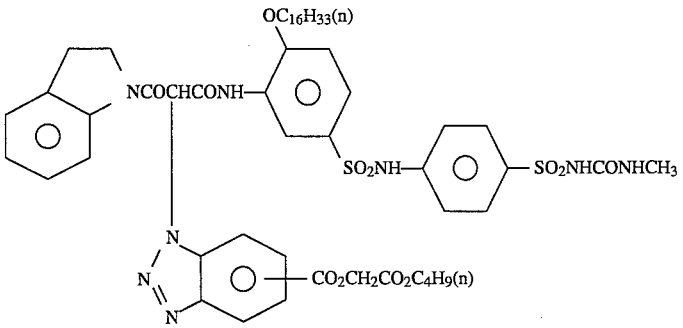
(37)
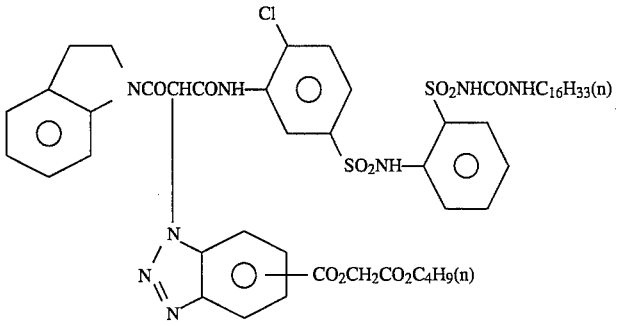
(38)
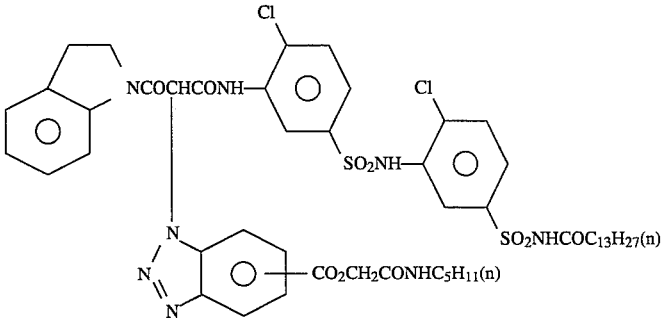
(39)
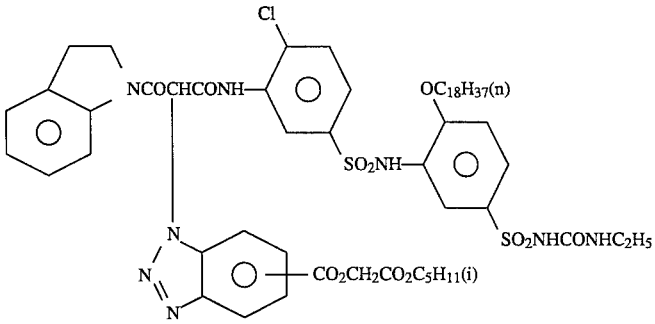
(40)
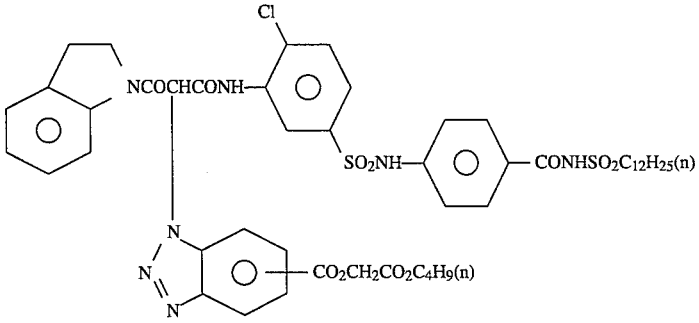

-continued
(41)
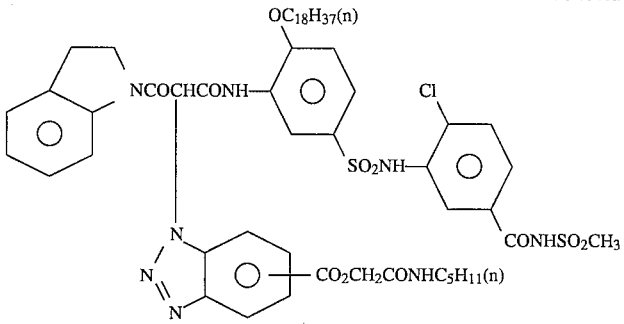
(42)
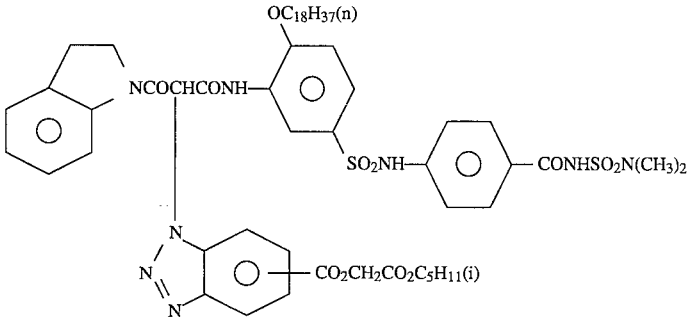
(43)
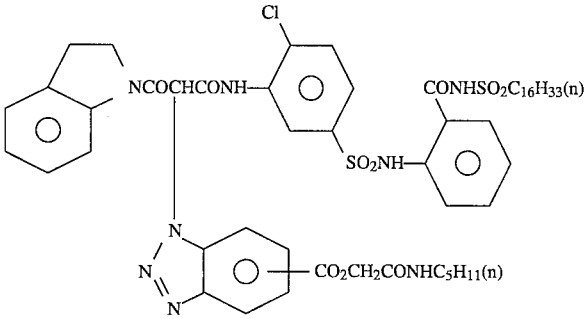
(44)
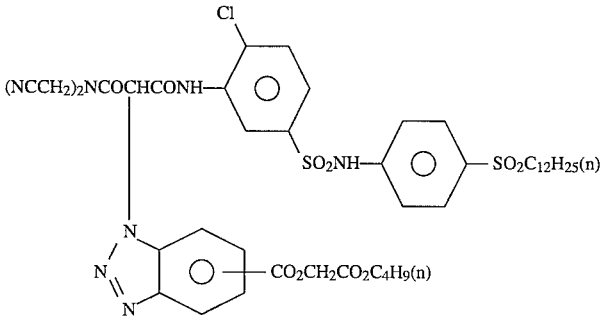

-continued
(45)
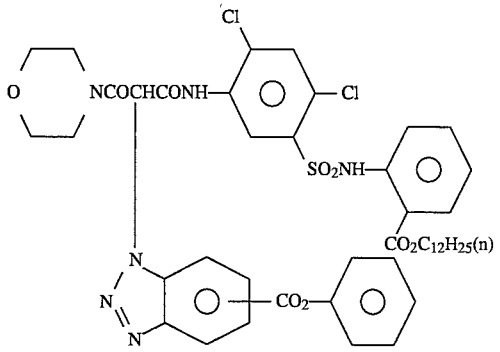
(46)
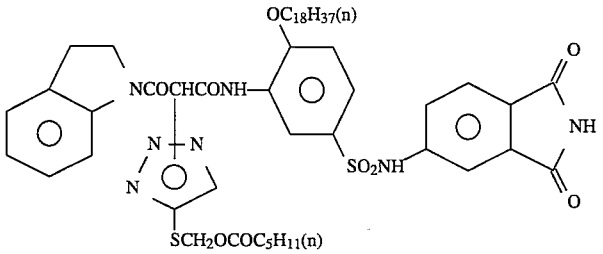
(47)
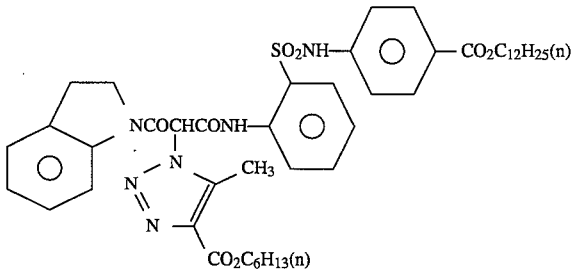
(48)
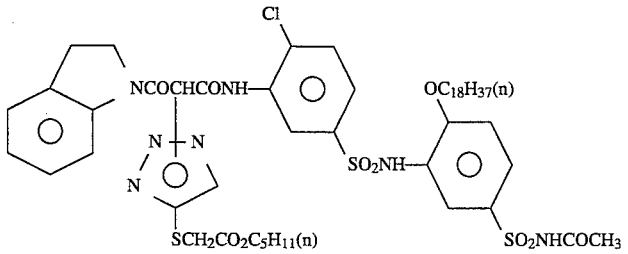
(49)
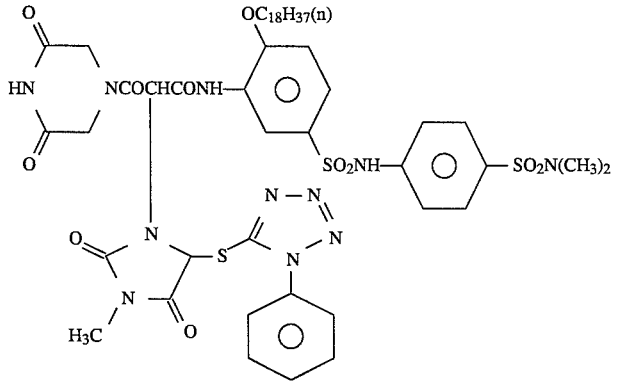

-continued
(50)
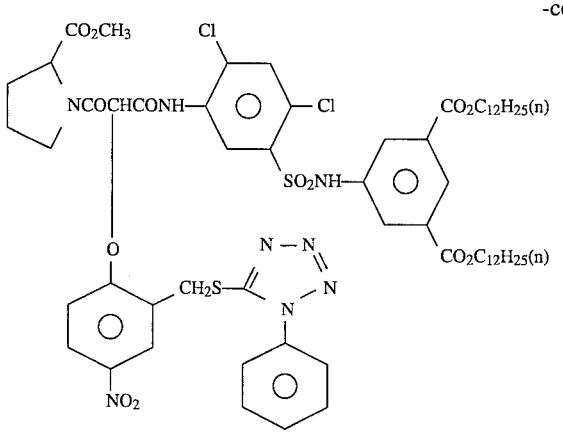
(51)
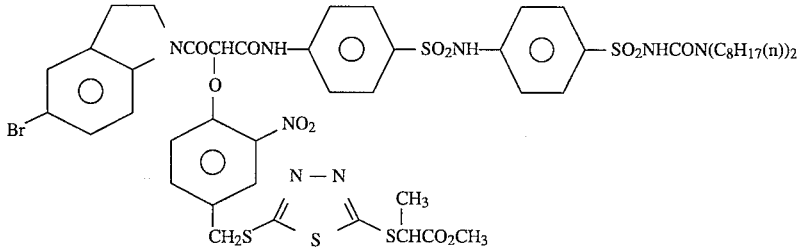
(52)
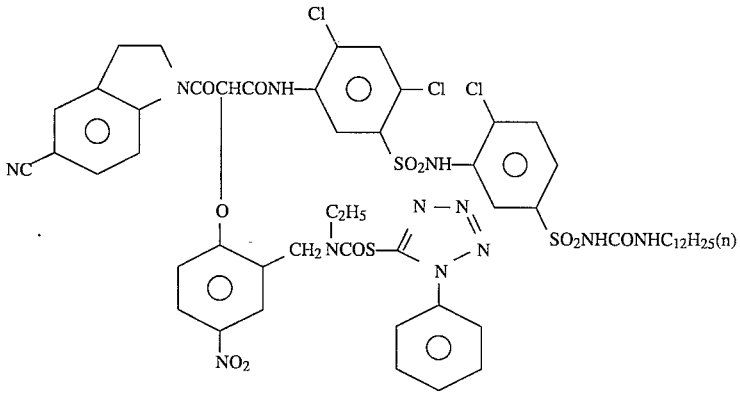
(53)
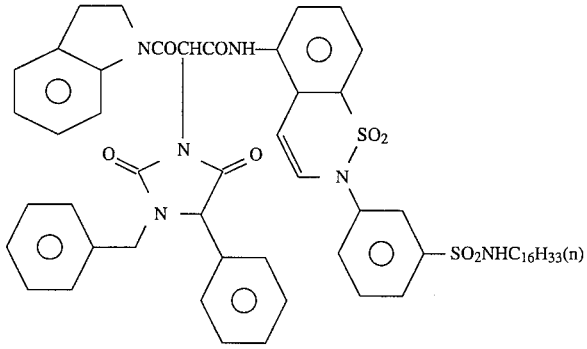

-continued
(54)
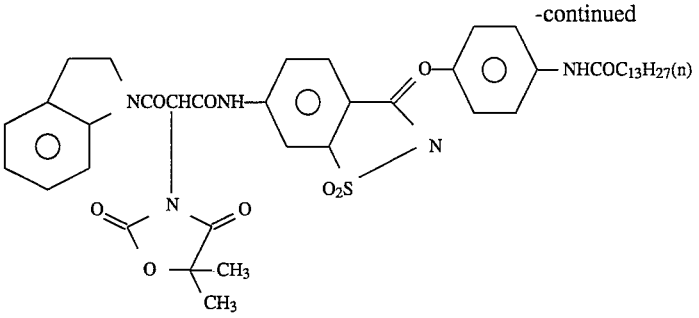
(55)
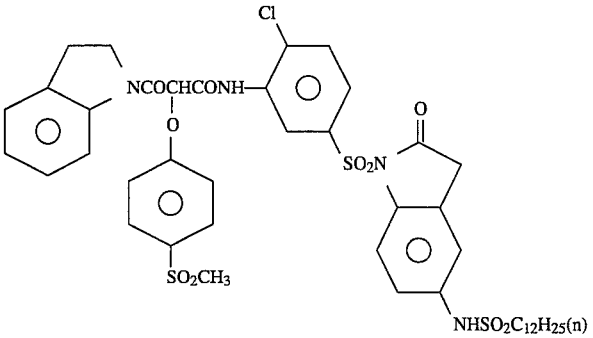
(56)
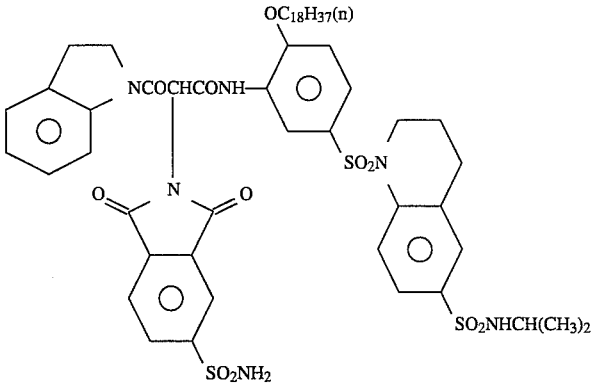
(57)
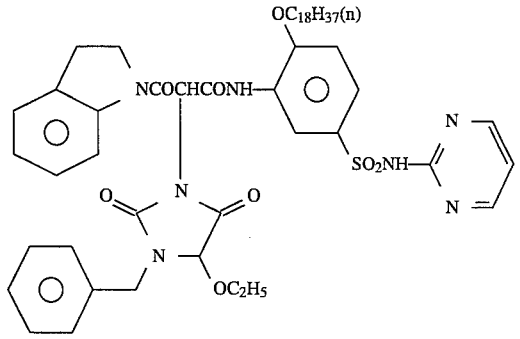
(58)
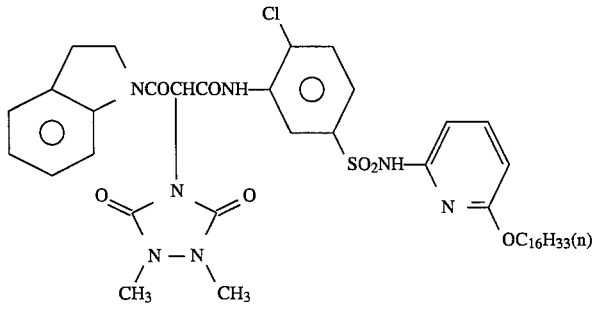

These compounds can be prepared easily using for example the method wherein XH (where X has the same meaning as in formula (I)) is reacted with a compound which can be represented by formula (II) or (III) in the presence of a base:

$$R^1R^2NCOCH(Br)CONH\text{-}\phi^1\text{-}SO_2NR^3\text{-}\phi^2 \quad (II)$$

$$R^1R^2NCOCH(Cl)CONH\text{-}\phi^1\text{-}SO_2NR^3\text{-}\phi^2 \quad (III)$$

wherein $R^1$ to $R^3$, $\phi^1$ and $\phi^2$ have the same meaning as in formula (I).

The preparation of some typical compounds from among the compounds of the present invention is described below. Other compounds can also be prepared in the same way.

Example of Synthesis 1-Synthesis of Illustrative Compound (1)

This compound was prepared using the synthetic route indicated below.

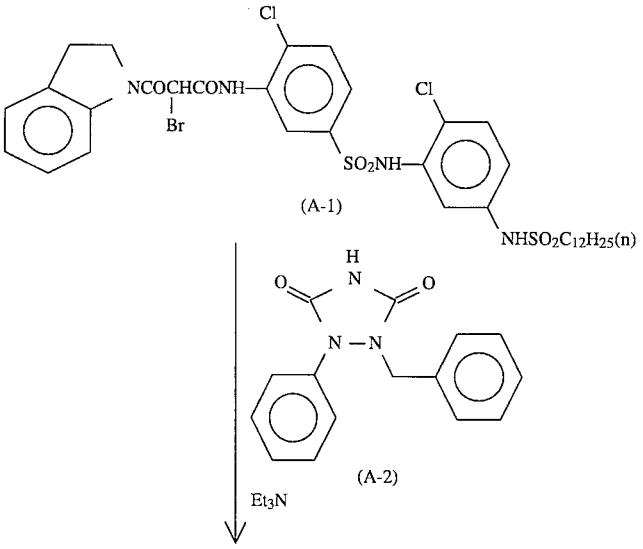

Illustrative Compound (1)

Compound (A-1) (30.0 grams) and 18.4 grams of compound (A-2) were mixed in 200 ml of N,N-dimethylacetamide and the mixture was stirred at room temperature. Triethylamine (7.31 grams) was added dropwise over a period of 45 minutes and the mixture was further stirred for 2 hours. The reaction mixture was then poured into water and extracted with ethyl acetate. The organic layer was washed with water, 5% aqueous sodium carbonate solution and then with dilute hydrochloric acid, after which it was dried over magnesium sulfate. The drying agent was removed by filtration and the solvent was distilled off, whereupon a yellow oily material was obtained. This was refined using silica gel chromatography and 27.4 grams of the target illustrative compound (1) was obtained as a colorless glass-like solid.

Example of Synthesis 2-Synthesis of Illustrative Compound (9)

This compound was prepared using the synthetic route indicated below.

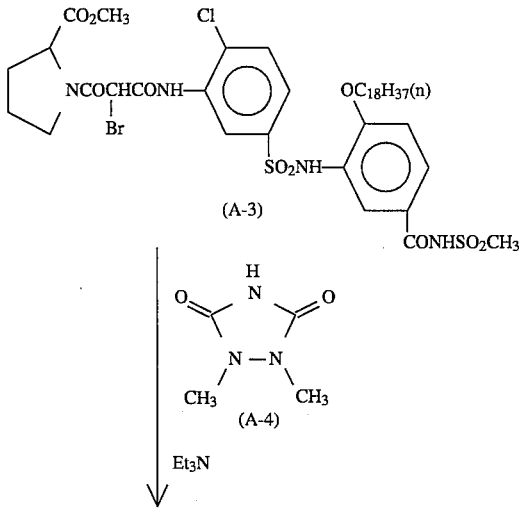

Illustrative Compound (9)

Compound (A-3) (17.5 grams) and 4.76 grams of compound (A-4) were mixed in 100 ml of N,N-dimethylacetamide and the mixture was stirred at room temperature. Triethylamine (3.74 grams) was added dropwise over a period of 20 minutes and the mixture was further stirred for 1 hour. The reaction mixture was then poured into water and extracted with ethyl acetate. The organic layer was washed with water, 5% aqueous sodium carbonate solution and then with dilute hydrochloric acid, after which it was dried over magnesium sulfate. The drying agent was removed by filtration and the solvent was distilled off, whereupon a yellow oily material was obtained. This was refined by silica gel chromatography and 16.6 grams of the target compound (9) was obtained as a pale yellow oily material.

Example of Synthesis 3-Synthesis of Illustrative Compound (29)

This compound was prepared using the synthetic route indicated below.

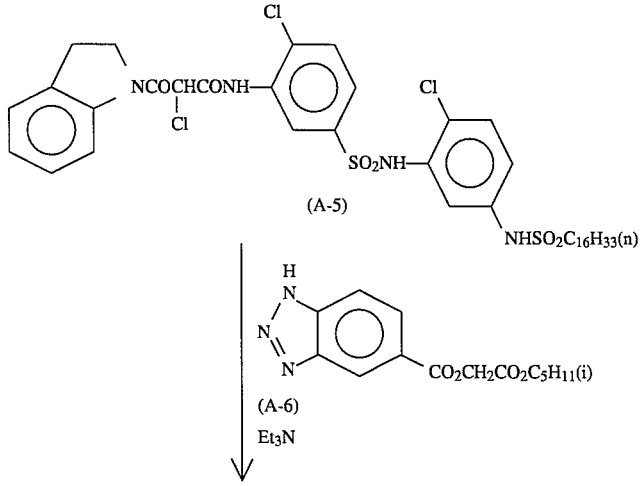

Illustrative Compound (29)

Compound (A-5) (20.0 grams) and 13.8 grams of compound (A-6) were mixed in 150 ml of N,N-dimethylacetamide and the mixture was stirred at room temperature.

Triethylamine (4.80 grams) was added dropwise over a period of 40 minutes and the mixture was further stirred for 2 hours. The reaction mixture was then poured into water and extracted with ethyl acetate. The organic layer was washed with water, 5% aqueous sodium carbonate solution and then with dilute hydrochloric acid, after which it was dried over magnesium sulfate. The drying agent was removed by filtration and the solvent was distilled off, whereupon a yellow oily material was obtained. This was refined by silica gel chromatography and 19.2 grams of the target compound (29) was obtained as a colorless glass-like solid.

Example of Synthesis 4-Synthesis of Illustrative Compound (35 ).

This compound was prepared using the synthetic route indicated below.

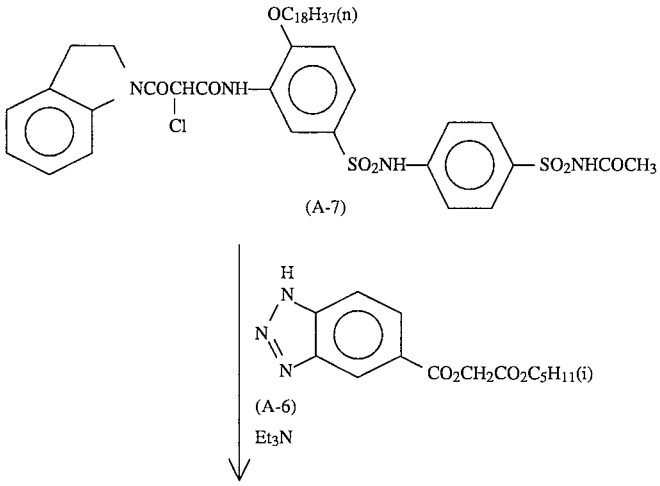

Illustrative Compound (35)

Compound (A-7) (15.0 grams) and 10.2 grams of compound (A-6) were mixed in 100 ml of N,N-dimethylacetamide and the mixture was stirred at room temperature. Triethylamine (3.54 grams) was added dropwise over a period of 25 minutes and the mixture was further stirred for 2 hours. The reaction mixture was then poured into water and extracted with ethyl acetate. The organic layer was washed with water, 5% aqueous sodium carbonate solution and then with dilute hydrochloric acid, after which it was dried over magnesium sulfate. The drying agent was removed by filtration and the solvent was distilled off, whereupon a yellow oily material was obtained. This was crystallized from ethanol and 11.7 grams of the target compound (35) was obtained as colorless crystals. The melting point was 109°to 112° C.

The coupler compounds represented by formula (I) of the present invention are preferably contained in a hydrophilic colloid layer in an amount of $1\times10^{-7}$ to 1.0 mole, particularly. $1\times10^{-6}$ to 0.5 mole, per mole of silver in the same layer or an adjacent layer thereto, although the content depends on the structure and the object of the coupler compounds.

The amount of the high boiling organic solvents which can be added to the coupler compound-containing layer(s) of the present invention is in a range of 10 to 0, preferably 2 or less, and particularly preferably 0.7 or less by weight to the total coupler content of the coupler compound-containing layer(s).

The coupler compounds of the present invention are used singly or in combination of two or more kinds thereof. Further, the coupler compounds of the present invention may be used together with the conventionally known coupler or couplers.

Known techniques and inorganic or organic materials which can be used for the color photographic material of the present invention are also described in European Patent 0 436 938 A2 as shown in the following table.

| | |
|---|---|
| 1. Layer constition: | page 146, line 34 to page 147, line 25 |
| 2. Silver halide emulsion: | page 147, line 26 to page 148, line 12 |
| 3. Yellow coupler: | page 137, line 35 to page 146, line 33 and page 149, lines 21–23 |
| 4. Magenta coupler: | page 149, lines 24–28; European Patent 421 453 A1, page 3, line 5 to page 25, line 55 |
| 5. Cyan coupler: | page 149, lines 29–33; European Patent 432 804 A2, page 3, line 28 to page 40, line 2 |
| 6. Polymer coupler: | page 149, lines 34–38; European Patent 435 334 A2, page 113, line 39 to page 123, line 37 |
| 7. Colored coupler: | page 53, line 42 to page 137, line 34 and page 149, lines 39–45 |
| 8. Other functional coupler: | page 7, line 1 to page 53, line 41, page 149, line 46 to page 150, line 3; European Patent 435 334 A2, page 3, line 1 to page 29, line 50 |
| 9. Preservative and fungicide | page 150, lines 25–28 |
| 10. Formaldehyde scavenger | page 149, lines 15–17 |
| 11. Other additive | page 153, lines 38–47; |

-continued

-continued

| | |
|---|---|
| | Euroepan Patent 421 453 Al, page 75, line 21 to page 84, line 56 and page 27, line 40 to page 37, line 40 |
| 12. Dispersing method | page 150, lines 4–24 |
| 13. Support | page 150, lines 32–34 |
| 14. Film thickness and film properties | page 150, lines 35–49 |
| 15. Color developing process | page 150, line 50 to page 151, line 47 |
| 16. Desilvering process | page 151, line 48 to page 152, line 53 |
| 17. Automatic developing machine | page 152, line 54 to page 1531 line 2 |
| 18. Water washing process and stabilization process | page 153, lines 3–37 |

The invention is described in more detail below by means of illustrative examples, but the invention is not limited by these examples.

EXAMPLE 1

Sample 101, a multi-layer color photosensitive material, was prepared by the lamination coating of the layers of which the compositions are indicated below on a cellulose triacetate film support on which an underlayer had been provided.

Photosensitive Layer Composition

The principal materials used in each layer can be classified as follows:

ExC: Cyan coupler

UV: Ultraviolet absorber

ExM: Magenta coupler

HBS: High boiling point organic solvent

ExY: Yellow coupler

ExS: Sensitizing dye

H: Gelatin hardening agent

The numerical value corresponding to each component indicates the coated weight expressed in units of g/m$^2$, and in the case of silver halides it indicates the coated weight calculated as silver. Furthermore, in the case of the sensitizing dyes the coated weight is shown in units of mol per mol of silver halide in the same layer.

| Sample 101 | |
|---|---|
| First Layer (Anti-halation Layer) | |
| Black colloidal silver | as silver 0.18 |
| Gelatin | 1.40 |
| ExM-1 | 0.18 |
| ExF-1 | $2.0 \times 10^{-3}$ |
| HBS-1 | 0.20 |
| Second Layer (Intermediate Layer) | |
| Emulsion G | as silver 0.065 |
| 2,5-Di-tert-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer | |

-continued

| Sample 101 | |
|---|---|
| (Low Speed Red Sensitive Emulsion Layer) | |
| Emulsion A | as silver 0.25 |
| Emulsion B | as silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.0 25 |
| HBS-1 | 0.10 |
| Gelatin | 0.87 |
| Fourth Layer (Intermediate Speed Red Sensitive Emulsion Layer) | |
| Emulsion D | as silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth Layer (High Speed Red Sensitive Emulsion Layer) | |
| Emulsion E | as silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer (Intermediate Layer) | |
| Cpd-1 | 0.10 |
| HBS-1 | 0.50 |
| Gelatin | 1.10 |
| Seventh Layer (Low Speed Green Sensitive Emulsion Layer) | |
| Emulsion C | as silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-2 | 0.010 |
| Gelatin | 0.73 |
| Eighth Layer (Intermediate Speed Green Sensitive Emulsion Layer) | |
| Emulsion D | as silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |

-continued

| Sample 101 | |
|---|---|
| HBS-1 | 0.16 |
| HBS-3 | $8.0 \times 10^{-3}$ |
| Gelatin | 0.90 |
| Ninth Layer (High Speed Green Sensitive Emulsion Layer) | |
| Emulsion E | as silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth Layer (Yellow Filter Layer) | |
| Yellow colloidal silver | as silver 0.030 |
| Cpd-1 | 0.16 |
| HBS-1 | 0.60 |
| Gelatin | 0.60 |
| Eleventh Layer (Low Speed Blue Sensitive Emulsion Layer) | |
| Emulsion C | as silver 0.18 |
| ExS-7 | $8.6 \times 10^{-4}$ |
| ExY-1 | 0.020 |
| ExY-2 | 0.72 |
| ExY-4 | 0.020 |
| HBS-1 | 0.28 |
| Gelatin | 1.10 |
| Twelfth Layer (Intermediate Speed Blue sensitive Emulsion Layer) | |
| Emulsion D | as silver 0.40 |

-continued

| Sample 101 | |
|---|---|
| ExS-7 | $7.4 \times 10^{-4}$ |
| ExC-7 | $7.0 \times 10^{-3}$ |
| ExY-2 | 0.15 |
| HBS-1 | 0.050 |
| Gelatin | 0.78 |
| Thirteenth Layer (High Speed Blue sensitive Emulsion Layer) | |
| Emulsion F | as silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer (First Protective Layer) | |
| Emulsion G | as silver 0.20 |
| UV-4 | 0.11 |
| UV-5 | 0.17 |
| HBS-1 | $5.0 \times 10^{-2}$ |
| Gelatin | 1.00 |
| Fifteenth Layer (Second Protective Layer) | |
| H-1 | 0.40 |
| B-1 (Diameter 1.7 μm) | $5.0 \times 10^{-2}$ |
| B-2 (Diameter 1.7 μm) | 0.10 |
| B-3 | 0.10 |
| S-1 | 0.20 |
| Gelatin | 1.20 |

Furthermore, W-1 to W-3, B-4 to B-6, F-1 to F-17 and iron salts, lead salts, gold salts, platinum salts, iridium salts and rhodium salts were contained suitably in each layer with a view to improving storage properties, processing properties, pressure resisting properties, fungicidal and biocidal properties, anti-static properties and coating properties.

TABLE 1

| Emulsion | Average AgI Content (%) | Average Grain Size (μm) | Variation Coefficient of the Grain Size (%) | Diameter/ Thickness Ratio | Amount of Silver Ratio [Core/Inter/Shell] (AgI Content) | Grain Structure/Form |
|---|---|---|---|---|---|---|
| A | 4.0 | 0.45 | 27 | 1 | [1/3] (13/1) | Double structure, octahedral grains |
| B | 8.9 | 0.70 | 14 | 1 | [3/7] (25/2) | Double structure, octahedral grains |
| C | 2.0 | 0.55 | 25 | 7 | — | Uniform structure, tabular grains |
| D | 9.0 | 0.65 | 25 | 6 | [12/59/29] (0/11/8) | Triple structure, tabular grains |
| E | 9.0 | 0.85 | 23 | 5 | [8/59/33] (0/11/8) | Triple Structure, tabular grains |
| F | 14.5 | 1.25 | 25 | 3 | [37/63] (34/3) | Double Structure, plate-like grains |
| G | 1.0 | 0.07 | 15 | 1 | — | Uniform structure, fine grains |

In table 1:

(1) The emulsions A to F were subjected to reduction sensitization during grain preparation using urea dioxide and thiosulfonic acid as in the examples of JP-A-2-191938.

(2) The emulsions A to F were subjected to gold sensitization, and sulfur sensitization and selenium sensitization, in the presence of sodium thiocyanate and the spectrally sensitizing dyes disclosed for each photosensitive layer, as in the examples of JP-A-3-237450.

(3) Low molecular weight gelatin was used in the preparation of the tabular grains as in the examples of JP-A-1-158426.

(4) The dislocation lines in the tabular grains and the regular crystalline grains which had a grain structure were observed using a high voltage electron microscope as disclosed in JP-A-3-237450.

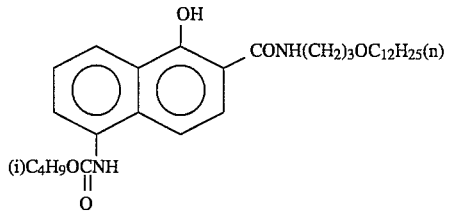
ExC-2
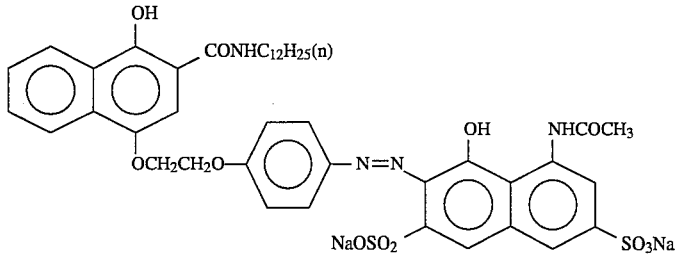
ExC-3
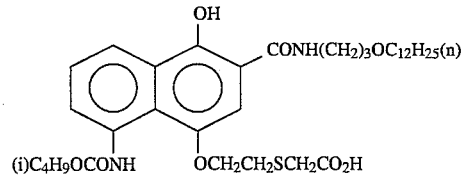
ExC-4
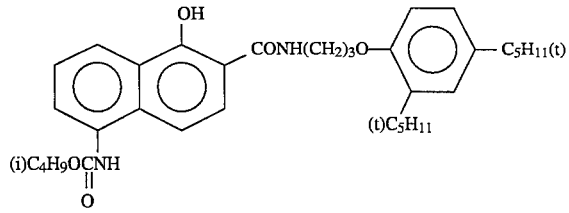
ExC-5
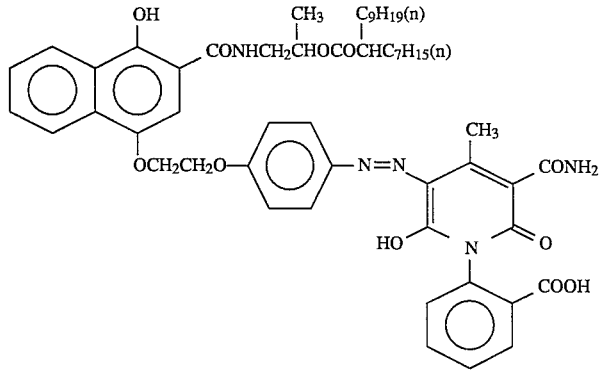
ExC-6
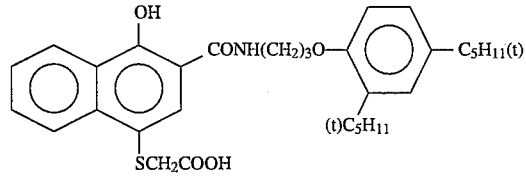

-continued
ExC-7
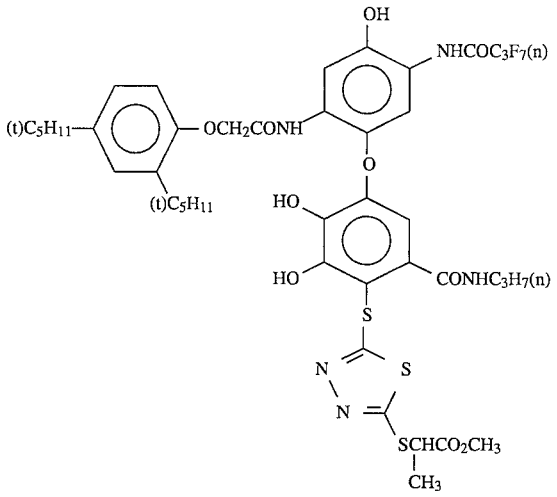
ExC-8
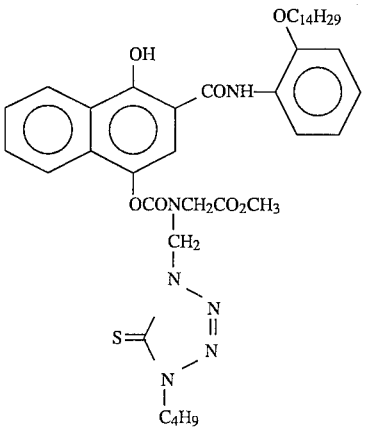
ExM-1
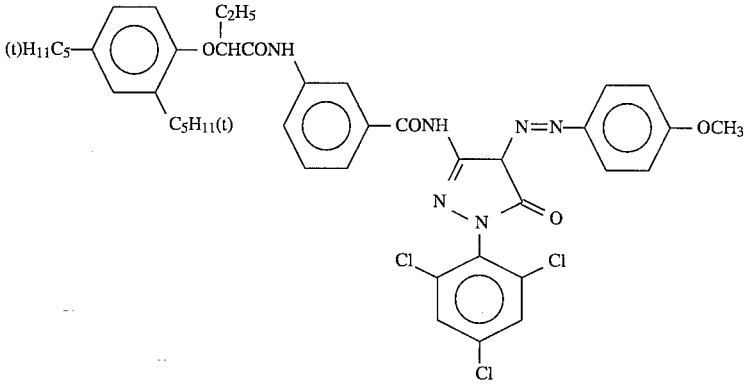

-continued
ExM-2
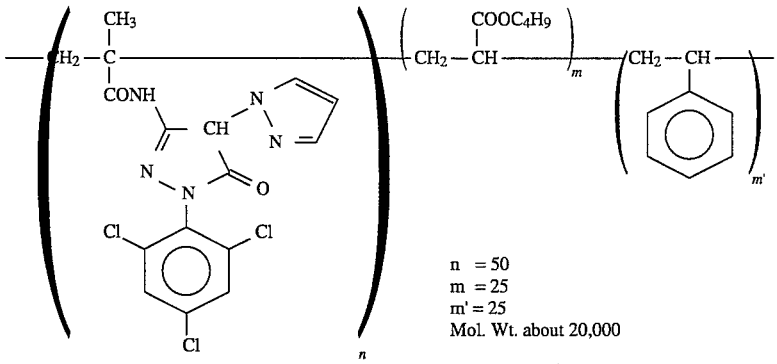
ExM-3
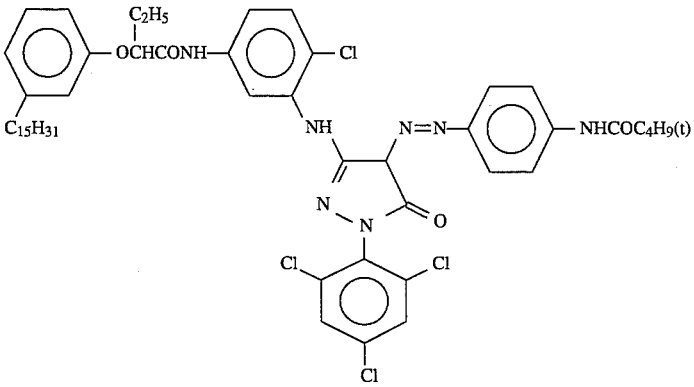
ExM-4
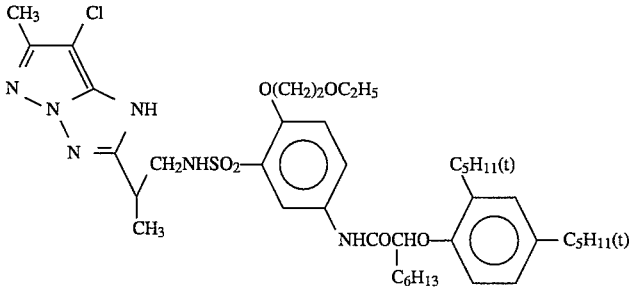
ExM-5
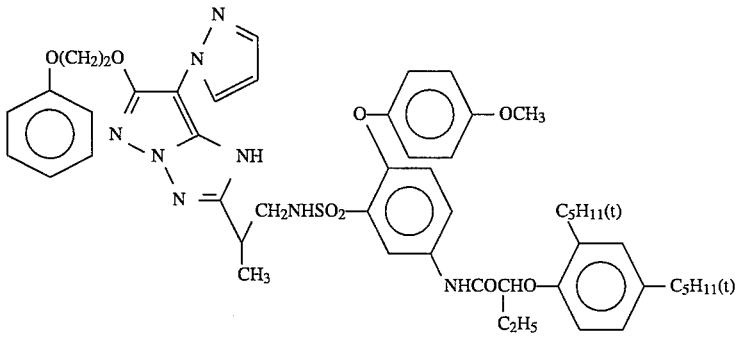

-continued
ExY-1
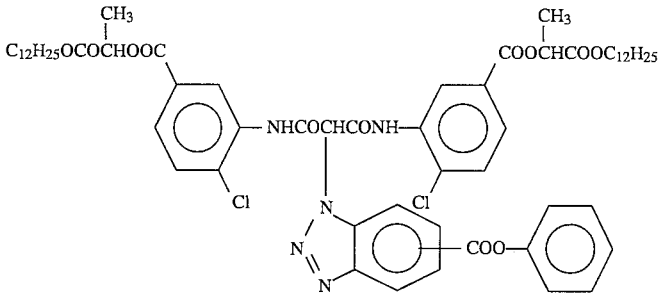
ExY-2
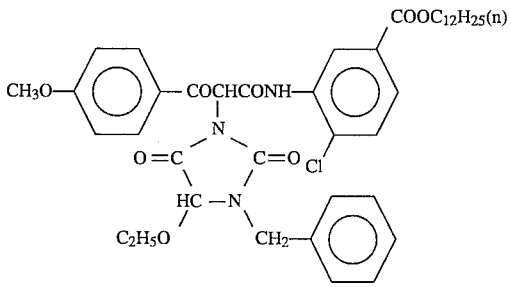
ExY-3
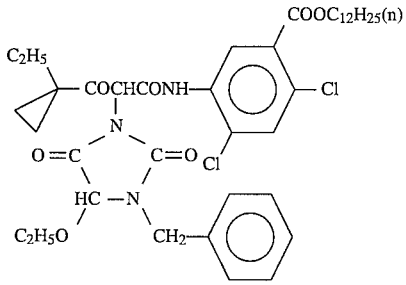
ExY-4
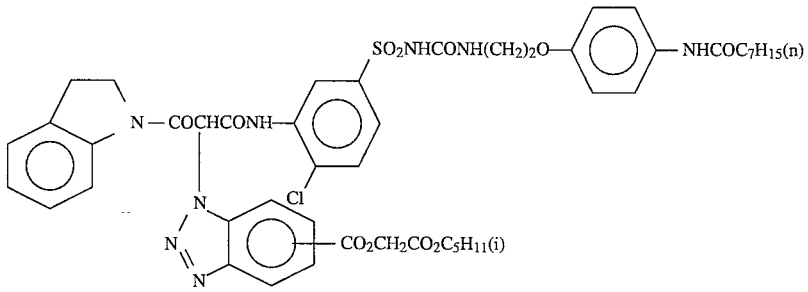
ExF-1
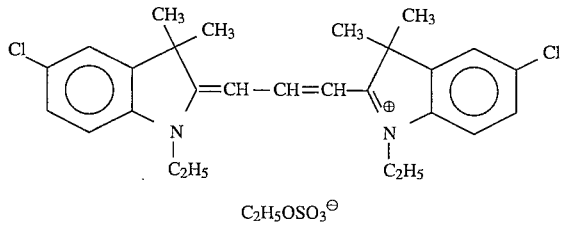
Cpd-1
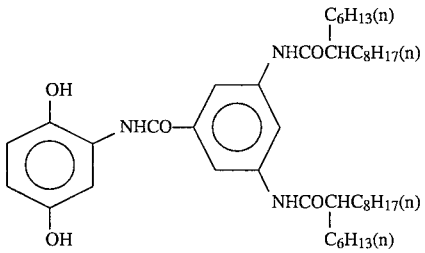
Cpd-2
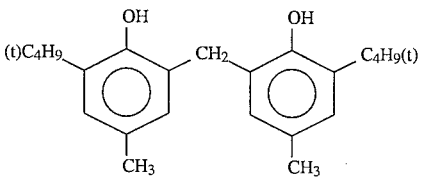
Cpd-3
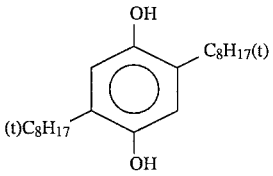
UV-1
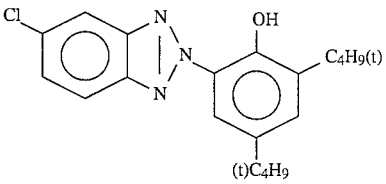

-continued
UV-2
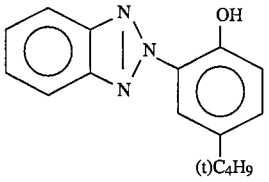
UV-3
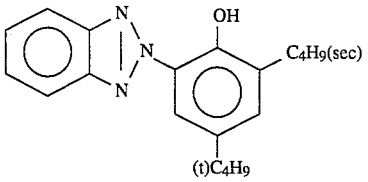
UV-4
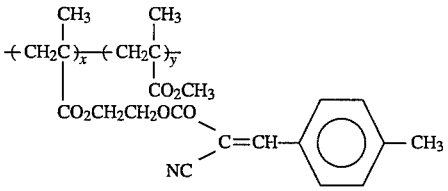
x:y = 70:30 (wt %)
UV-5
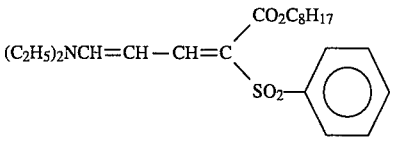
Tricresyl phosphate HBS-1
Di-n-butyl phthalate HBS-2
HBS-3
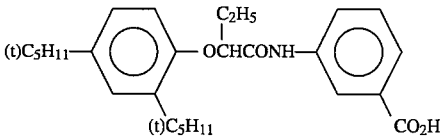
ExS-1
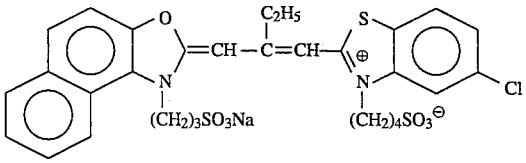
ExS-2
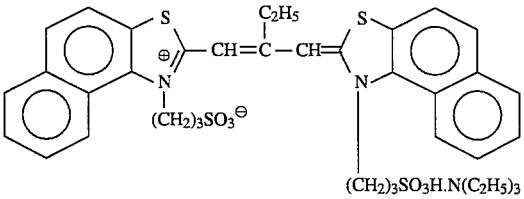
ExS-3
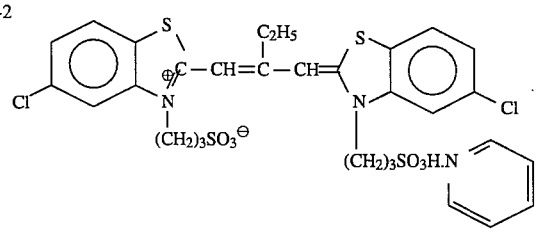
ExS-4
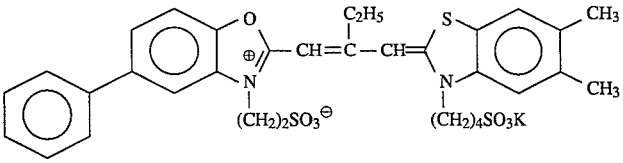
ExS-5
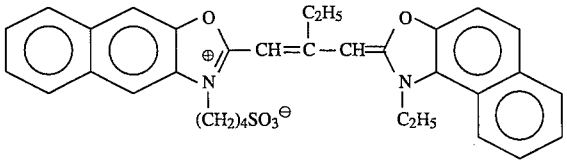
ExS-6
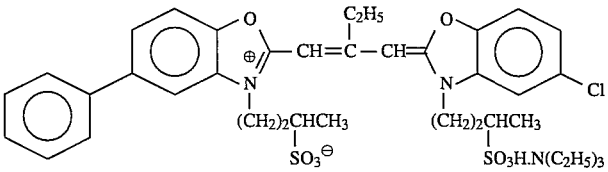
ExS-7
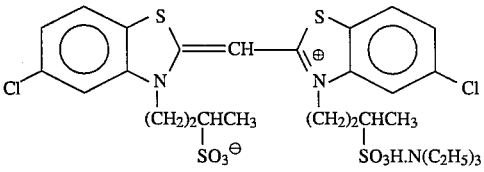
S-1
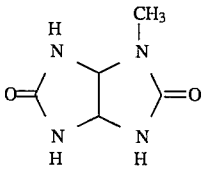

-continued
H-1
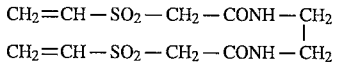
B-1
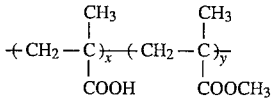
x/y = 10/90
B-2
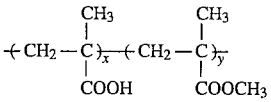
x/y = 40/60
B-3
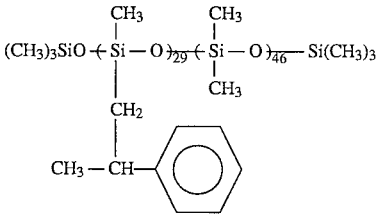
B-4
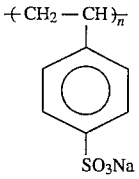
B-5
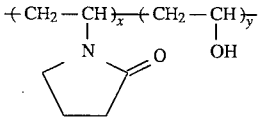
x/y = 70/30
B-6
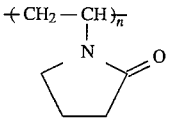
W-1
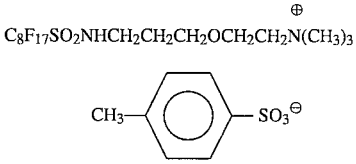
W-2
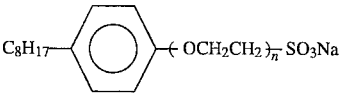
n = 2~4
W-3
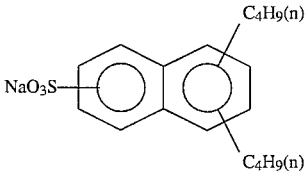
F-1
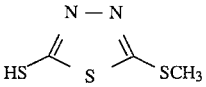
F-2
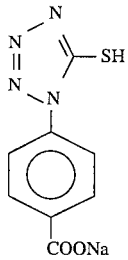
F-3
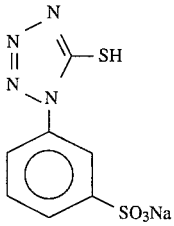
F-4
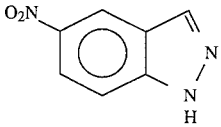
F-5
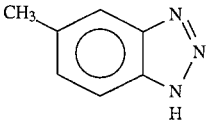
F-6
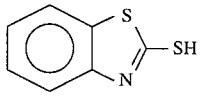

-continued
F-7
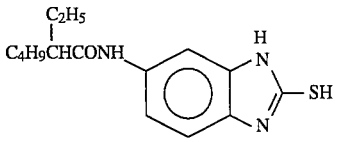
F-8
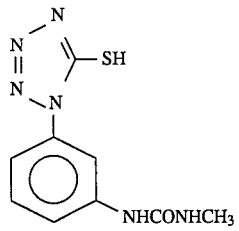
F-9
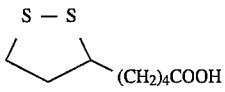
F-10
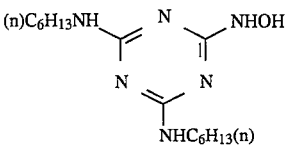
F-11
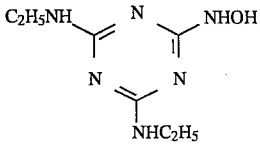
F-12
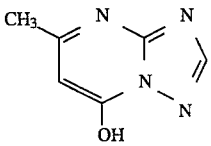
F-13
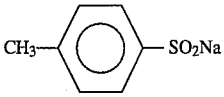
F-14
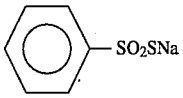
F-15
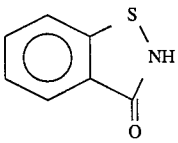
F-16
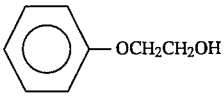
F-17
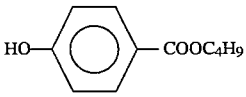
Disclosed in JP-A-63-201655 (Actual Example 4) RC-1
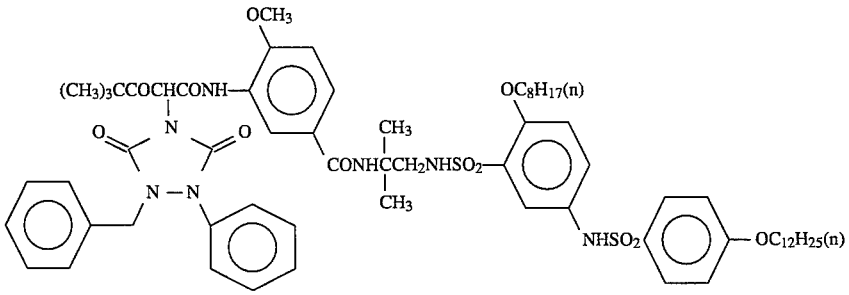
Disclosed in JP-B-2-13777 (Actual Example 9) RC-2
Disclosed in U.S. Pat. No. 4,356,258 (Actual Example 1) RC-3
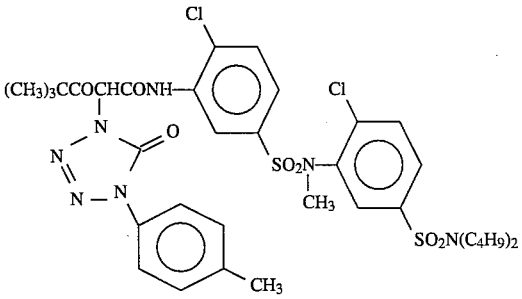
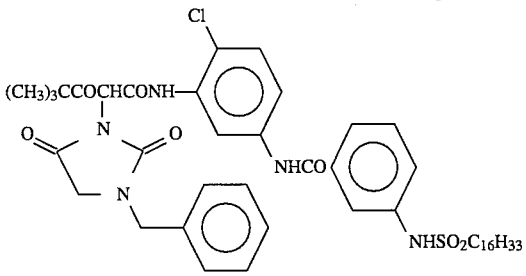
Disclosed in U.S. Pat. No. 4,617,256 (Actual Example 7) RC-4

-continued

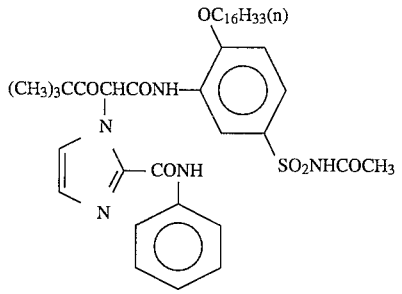

Disclosed in JP-B-62-61251 (Actual Example 5) RC-5

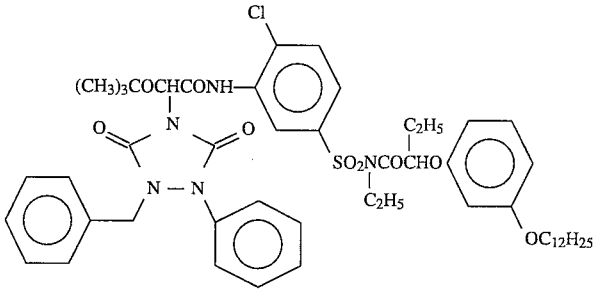

RC-6

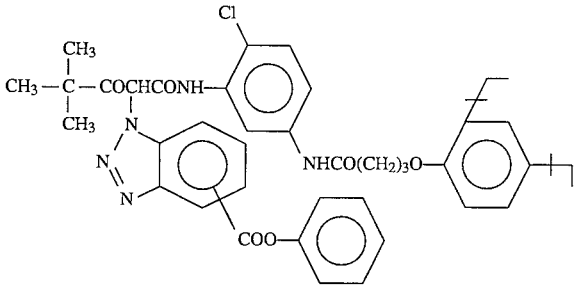

Disclosed in EP-447920 (Actual Example 1) RC-7

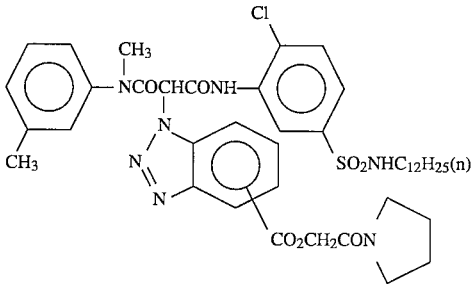

Disclosed in U.S. Pat. No. 5,035,987 (Actual Example DIR-1) RC-8

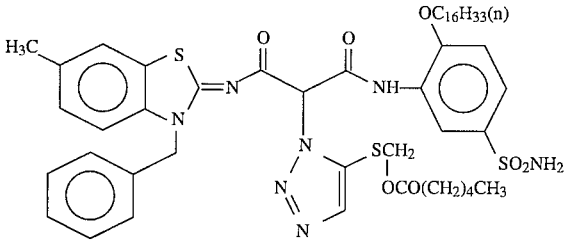

Samples 102 to 116 were prepared by replacing the yellow couplers ExY-1 and/or ExY-2 in the eleventh to thirteenth layers in sample 101 with the aforementioned comparative compounds (RC-1 to RC-5) and compounds of the present invention. Moreover, the compounds were used in amounts equimolar with those used in sample 101.

The samples 101 to 116 so obtained were subjected to a wedge exposure to blue light and processed using the procedure indicated below. Moreover, processing was carried out by processing Super HG-400 made by the Fuji Photo Film Co. which had been subjected to a standard exposure until the amount of replenishment of each bath reached three times the tank capacity.

The processing operations and compositions of the processing baths are indicated below.

Processing Operations

| Process | Processing Time | Processing Temperature | Replenishment Rate* | Tank Capacity |
|---|---|---|---|---|
| Color Development | 3 min. 5 sec. | 38.0° C. | 600 ml | 17 liters |
| Bleach | 50 seconds | 38.0° C. | 140 ml | 5 liters |
| Bleach-fix | 50 seconds | 38.0° C. | — | 5 liters |
| Fix | 50 seconds | 38.0° C. | 420 ml | 5 liters |
| Water Wash | 30 seconds | 38.0° C. | 980 ml | 3.5 liters |
| Stabilize (1) | 20 seconds | 38.0° C. | — | 3 liters |
| Stabilize (2) | 20 seconds | 38.0° C. | 560 ml | 3 liters |
| Drying | 1 min. 30 sec. | 60.0° C. | | |

*The replenishment rate is the amount per square meter of photosensitive material.

The stabilizer was used in a counter-flow system from (2) to (1) and the overflow from the water wash was all introduced into the fixer tank. Replenishment of the bleach-fix bath was accomplished by establishing a cut out in the top of the bleach tank and in the top of the fixer tank of the automatic processor and introducing all of the liquid overflow produced as a result of supplying replenisher to the bleach tank and the fixer tank into the bleach-fix bath. Moreover, the carry-over of developer into the bleach process was 65 ml per square meter of photosensitive material, the carry-over of bleaching solution into the bleach-fix process was 50 ml per square meter of photosensitive material, the carry-over of bleach-fixer into the fixing process was 50 ml per square meter of photosensitive material and the carry-over of fixer into the water washing process was 50 ml per square meter of photosensitive material. Furthermore, the cross-over time was 6 seconds in each case and this time is included in the processing time of the previous operation.

The compositions of the processing liquids are indicated below.

| | Tank Liquid (grams) | Replenisher (grams) |
|---|---|---|
| Color Developer | | |
| Diethylenetriamine penta-acetic acid | 2.0 | 2.0 |
| 1-Hydroxyethylidene-1,1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Ethyl-4-(N-ethyl-N-(β-hydroxyethyl)amino]aniline sulfate | 4.5 | 6.0 |
| Water to make | 1.0 liter | 1.0 liter |
| pH | 10.05 | 10.15 |

-continued

| | | |
|---|---|---|
| Bleaching Solution | | |
| 1,3-diaminopropane tetra-acetic acid, ferrous ammonium salt, mono-hydrate | 130 | 195 |
| Ammonium bromide | 70 | 105 |
| Ammonium nitrate | 14 | 21 |

-continued

| | | |
|---|---|---|
| Hydroxyacetic acid | 50 | 75 |
| Acetic acid | 40 | 60 |
| Water to make | 1.0 liter | 1.0 liter |
| pH (Adjusted with aqueous ammonia) | 4.4 | 4.4 |
| Bleach-fixer Tank Liquid | | |
| A mixture in the proportions (by volume) of 15:85 of the bleach tank liquid described above and the fixer tank liquid described below. (pH 7.0) | | |
| Fixer | | |
| Ammonium sulfite | 19 | 57 |
| Aqueous ammonium thio-sulfate solution (700 g/l) | 280 ml | 840 ml |
| Imidazole | 15 | 45 |
| Ethylenediamine tetra-acetic acid | 15 | 45 |
| Water to make | 1.0 liter | 1.0 liter |
| pH (Adjusted with aqueous ammonia, acetic acid) | 7.4 | 7.45 |
| Water Washing Water | | |
| Town water was treated by being passed through a mixed bed column which had been packed with an H-type strongly acidic cation exchange resin (Amberlite IR-120B, made by the Rohm and Haas Co.) and an OH-type strongly basic anion exchange resin (Amberlite IR-400, made by the same company) and the calcium and magnesium ion concentrations were set to not more than 3 mg/liter, and then 20 mg/liter of sodium isocyanurate dichloride and 150 mg/liter of sodium sulfate were added. The pH of this liquid was in the range from 6.5 to 7.5. | | |

| Stabilizer (Tank liquid = Replenisher) | (Units: Grams) |
|---|---|
| Sodium p-toluenesulfinate | 0.03 |
| Polyoxyethylene p-monononylphenyl ether (average degree of polymerization 10) | 0.2 |
| Ethylenediamine tetra-acetic acid, di-sodium salt | 0.05 |
| 1,2,4-Triazole | 1.3 |
| 1,4-Bis(1,2,4-triazol-1-ylmethyl)- | 0.75 |

-continued

| | |
|---|---|
| piperazine | |
| Water to make | 1.0 liter |
| pH | 8.5 |

The yellow densities of the processed samples so obtained were measured and the yellow density of each sample at the exposure which provided a density of (fog +1.8) with sample 101 was obtained, and the color forming properties were evaluated. The values are shown as relative values taking that for sample 101 to be 1.0.

Moreover, each sample obtained was left to stand for 4 weeks under conditions of 60° C., 70% RH, after which the amount of dye remaining was obtained and the yellow colored image fastness was evaluated. The amount of dye remaining is indicated as a percentage derived by obtaining the (yellow density —fog) density after the test at the point where the density of the sample before the test was (fog +1.2).

The results obtained are shown in Table 2.

TABLE 2

| Sample Number | Yellow Couplers in the Eleventh–Thirteenth Layers | | Color Forming Properties | Colored Image Fastness (Amount of Dye Remaining After 4 Weeks at 60° C., 70% RH) | Remarks |
|---|---|---|---|---|---|
| 101 | ExY-1 | ExY-2 | 1.0 | 82 | Comparative Example |
| 102 | " | RC-1 | 0.69 | 88 | " |
| 103 | " | RC-2 | 0.68 | 88 | " |
| 104 | " | RC-3 | 0.66 | 87 | " |
| 105 | " | RC-4 | 0.67 | 88 | " |
| 106 | " | RC-5 | 0.67 | 88 | " |
| 107 | " | (1) | 1.22 | 94 | This Invention |
| 108 | " | (3) | 1.21 | 94 | " |
| 109 | " | (5) | 1.20 | 95 | " |
| 110 | " | (6) | 1.21 | 93 | " |
| 111 | " | (7) | 1.21 | 94 | " |
| 112 | " | (9) | 1.19 | 94 | " |
| 113 | " | (10) | 1.20 | 93 | " |
| 114 | " | (11) | 1.19 | 93 | " |
| 115 | (23) | (15) | 1.21 | 98 | " |
| 116 | (35) | (17) | 1.20 | 98 | " |

It is clear from Table 2 that photosensitive materials of which the color forming properties of the blue sensitive layer are markedly improved and with which the colored image fastness is excellent can be provided by using the compounds of the present invention. Furthermore, it is clear that the colored image fastness is markedly improved when the main couplers and the development inhibitor releasing couplers in the blue layer are replaced at the same time with compounds of the present invention (samples 115 and 116 in Table 2).

EXAMPLE 2

Samples 201 to 211 were prepared by replacing the development inhibitor releasing (referred to hereinafter as DIR) coupler (ExY-1) which had been used in the seventh, eighth and eleventh layers of sample 101 as used in Example 1 with the comparative compounds and compounds of the present invention shown in Table 3. Moreover, the amount of the coupler added was adjusted in such a way as to match the gradation in sample 101.

Sample 101 and each of the other samples was exposed with a pattern for MTF measurement purposes using white light and then they were developed and processed using the same procedure as described in Example 1 and the MTF values for yellow, magenta and cyan at 25 cycles/mm were measured. The MTF values were obtained using the method described in *The Theory of the Photographic Process*, 3rd Edition, by Mees (published by Macmillan). Moreover, the yellow colored image fastness was also evaluated in the same way as in Example 1.

It is clear from the results shown in Table 3 that the fastness is good and the sharpness is excellent when the compounds of the present invention are used as DIR couplers.

TABLE 3

| Sample Number | Coupler in the Seventh, Eighth and Eleventh Layers | MTF Value Yellow | MTF Value Magenta | MTF Value Cyan | Colored Image Fastness (After 4 Weeks at 60° C., 70% RH) (%) | Remarks |
|---|---|---|---|---|---|---|
| 101 | ExY-1 | 0.78 | 0.63 | 0.44 | 82 | Comparative Example, |
| 201 | RC-6 | 0.78 | 0.62 | 0.4 4 | 90 | " |
| 202 | RC-7 | 0.78 | 0.62 | 0.43 | 84 | " |
| 203 | RC-8 | 0.77 | 0.63 | 0.43 | 80 | " |
| 204 | (23) | 0.81 | 0.66 | 0.46 | 93 | This Invention |
| 205 | (27) | 0.82 | 0.66 | 0.46 | 94 | " |
| 206 | (29) | 0.81 | 0.66 | 0.46 | 92 | " |
| 207 | (33) | 0.81 | 0.65 | 0.46 | 92 | " |
| 208 | (34) | 0.82 | 0.66 | 0.47 | 94 | " |
| 209 | (35) | 0.81 | 0.65 | 0.46 | 93 | " |

TABLE 3-continued

| Sample Number | Coupler in the Seventh, Eighth and Eleventh Layers | MTF Value Yellow | MTF Value Magenta | MTF Value Cyan | Colored Image Fastness (After 4 Weeks at 60° C., 70% RH) (%) | Remarks |
|---|---|---|---|---|---|---|
| 210 | (39) | 0.81 | 0.65 | 0.46 | 94 | " |
| 211 | (41) | 0.81 | 0.66 | 0.46 | 93 | " |

The present invention enables good photographic images which have excellent sharpness, high photographic speed and a high degree of fastness to be obtained by forming images in the presence of couplers represented by formula (I) which have a high rate of dye formation, which have a high color forming density and with which the dye which is formed has a high degree of fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one hydrophilic colloid layer containing a coupler represented by formula (I):

$$R^1R^2NCOCHXCONH\text{-}\phi^1\text{-}SO_2NR^3\text{-}\phi^2 \quad (I)$$

wherein $R^1$ and $R^2$ each independently represents an alkyl group, an aryl group or a heterocyclic group, $R^3$ represents a hydrogen atom, an alkyl group, an aryl group or a heterocyclic group, X represents a group which can be eliminated when the coupler compound reacts with an oxidized product of a primary aromatic amine developing agent, $\phi^1$ represents a phenylene group, and $\phi^2$ represents an aryl group or a heterocyclic group, and has $—CO_2R^4$, $—CONR^5R^6$, $—NR^5COR^4$, $—SO_2R^4$, $—SO_2NR^5R^6$ or $—NR^5SO_2R^4$ as a substituent group, wherein $R^4$ represents an alkyl group, an aryl group or a heterocyclic group, $R^5$ represents a hydrogen atom, an alkyl group, an aryl group or a heterocyclic group, $R^6$ represents a hydrogen atom, an alkyl group, an aryl group, a heterocyclic group, $—COR^7$, $—CO_2R^7$, $—CONR^8R^9$, $—SO_2R^7$ or $—SO_2NR^8R^9$, wherein $R^7$ represents an alkyl group, an aryl group or a heterocyclic group, and $R^8$ and $R^9$ each independently represents a hydrogen atom, an alkyl group, an aryl group or a heterocyclic group, and the above-mentioned substituent groups for $\phi^2$ may be further substituted and the substituent groups may be the same or different, and $R^4$ and $\phi^2$, and $R^5$ and $\phi^2$, $R^6$ and $\phi^2$, $R^5$ and $R^6$ or $R^8$ and $R^9$ may be linked to form a ring, and $R^1$ and $R^2$, $R^3$ and $\phi^1$, or $R^3$ and $\phi^2$ may be linked to form a ring.

2. The silver halide color photographic material of claim 1, wherein the alkyl groups represented by $R^1$, $R^2$ and $R^3$ and in formula (I) have from 3 to 30 carbon atoms.

3. The silver halide color photographic material of claim 1, wherein the alkyl groups represented by $R^1$, $R^2$, $R^3$ and $\phi^2$ in formula (I) have from 6 to 20 carbon atoms.

4. The silver halide color photographic material of claim 1, wherein the heterocyclic groups represented by $R^1$, $R^2$, $R^3$ and $\phi_2$ in formula (I) are from five to seven membered rings which have nitrogen, oxygen and sulfur as hetero atoms, and have from 1 to 10 carbon atoms.

5. The silver halide color photographic material of claim 1, wherein X is an aryloxy group, a heterocyclic oxy group, an arylthio group, a heterocyclic thio group, an imido group which is bonded by a nitrogen atom to the coupling position, or an unsaturated nitrogen containing heterocyclic group which is bonded by a nitrogen atom to the coupling position.

6. The silver halide color photographic material of claim 1, wherein $R^1$ and $R^2$ are alkyl groups or aryl groups.

7. The silver halide color photographic material of claim 1, wherein $R^3$ is a hydrogen atom.

8. The silver halide color photographic material of claim 1, wherein X is a nitrogen containing heterocyclic group.

9. The silver halide color photographic material of claim 1, wherein X is a five membered cyclic imido group bonded by the nitrogen atom to the coupling position, 1-pyrazolyl, 1-imidazolyl, 1,2,4-triazolyl bonded at the 1-position or the 4-position with coupling position, 1-benzotriazolyl or 1,2,3-triazolyl.

10. The silver halide color photographic material of claim 1, wherein $\phi^1$ is substituted with a halogen atom or an alkoxy group.

11. The silver halide color photographic material of claim 1, wherein the alkyl groups represented by $R^4$–$R^9$ have from 3 to 30 carbon atoms.

12. The silver halide color photographic material of claim 1, wherein the aryl groups represented by $R^4$–$R^9$ have from 6 to 20 carbon atoms.

13. The silver halide color photographic material of claim 1, wherein the heterocyclic groups represented by $R^4$–$R^9$ are from five to seven membered rings which have nitrogen, oxygen and sulfur as hetero atoms, and have from 1 to 10 carbon atoms.

14. The silver halide color photographic material of claim 1, wherein $R^4$ and $R^7$ are alkyl groups.

15. The silver halide color photographic material of claim 1, wherein $R^5$ and $R^8$ are hydrogen atoms.

16. The silver halide color photographic material of claim 1, wherein $R^9$ is an alkyl group or an aryl group.

17. The silver halide color photographic material of claim 1, wherein $R^6$ is $—COR^7$, $—CONR^8R^9$ , $—SO_2R^7$, or $—SO_2NR^8R^9$.

18. The silver halide color photographic material of claim 1, wherein when $R^1$ and $R^2$ represent an aryl group, said aryl group is a phenyl group.

19. The silver halide color photographic material of claim 1, wherein the couplers represented by formula (I) are nondiffusible.

20. The silver halide color photographic material of claim 1, wherein the coupler commands represented by formula (I) are present in an amount of $1\times10^{-7}$ to 1.0 mole per mole of silver in the same layer or an adjacent layer thereto.

* * * * *